US011208888B2

(12) United States Patent
Pu et al.

(10) Patent No.: US 11,208,888 B2
(45) Date of Patent: Dec. 28, 2021

(54) PROCESS AND DEVICE FOR SUPPORTING ANCHOR BOLT AND ANCHOR CABLE ON SUCCESSIVE MINING WORKING FACE

(71) Applicant: LANG FANG JING LONG GRAND INDUSTRIAL MACHINERY CO., LTD., Hebei (CN)

(72) Inventors: Changyan Pu, Hebei (CN); Mingpu Wang, Hebei (CN); Limin Wu, Hebei (CN); Fang Liu, Hebei (CN); Yaohui Fan, Hebei (CN); Peng Wang, Hebei (CN); Minglei Wang, Hebei (CN); Lihui Li, Hebei (CN); Fei Han, Hebei (CN); Kai Guo, Hebei (CN)

(73) Assignee: LANG FANG JING LONG GRAND INDUSTRIAL MACHINERY CO., LTD., Hebei (CN)

( * ) Notice: Subject to any disclaimer, the term of this patent is extended or adjusted under 35 U.S.C. 154(b) by 0 days.

(21) Appl. No.: 16/761,814

(22) PCT Filed: Oct. 25, 2018

(86) PCT No.: PCT/CN2018/111871
§ 371 (c)(1),
(2) Date: May 6, 2020

(87) PCT Pub. No.: WO2019/085819
PCT Pub. Date: May 9, 2019

(65) Prior Publication Data

US 2021/0180453 A1 Jun. 17, 2021

(30) Foreign Application Priority Data

Nov. 6, 2017 (CN) ..... 201711078992.X
Nov. 6, 2017 (CN) ..... 201711079978.1
Nov. 6, 2017 (CN) ..... 201711080738.3

(51) Int. Cl.
*E21D 20/00* (2006.01)

(52) U.S. Cl.
CPC ..... *E21D 20/003* (2013.01)

(58) Field of Classification Search
CPC ..... E21D 20/003
See application file for complete search history.

(56) References Cited

U.S. PATENT DOCUMENTS 5,816,750 A * 10/1998 Steffenino ..... E21D 11/152 405/302.3
6,497,536 B1 * 12/2002 Neilson ..... B25H 3/022 173/32
2017/0183966 A1 * 6/2017 Wilson ..... E21D 11/40

FOREIGN PATENT DOCUMENTS

CN 101403302 A 4/2009
CN 201225153 Y 4/2009
(Continued)

*Primary Examiner* — Carib A Oquendo
(74) *Attorney, Agent, or Firm* — Yu Gang

(57) ABSTRACT

A process for supporting an anchor bolt and an anchor cable on a continuous mining working face is provided. A four-arm top anchor bolt drill carriage serves as a front carriage, a six-arm side anchor bolt and top anchor cable and top anchor cable drill carriage serves as a rear carriage, and the two carriages are arranged in a front-rear direction to work in parallel. Four anchor bolt drill machines of the four-arm top anchor bolt drill carriage face to a top plate. Two drill machines are disposed in front of the six-arm side anchor bolt and the top anchor cable drill carriage. At a distance of four meters away, another two drill machines are disposed. Two top anchor cable drill machines are disposed in a middle of the anchor bolt drill machines and face to the top plate.

20 Claims, 15 Drawing Sheets

(56) References Cited

FOREIGN PATENT DOCUMENTS

| | | | |
|---|---|---|---|
| CN | 102536229 | A | 7/2012 |
| CN | 203175396 | U | 9/2013 |
| CN | 104196446 | A | 12/2014 |
| CN | 204024470 | U | 12/2014 |
| CN | 104564050 | A | 4/2015 |
| CN | 204311971 | U | 5/2015 |
| CN | 204921002 | U | 12/2015 |
| CN | 105443037 | A | 3/2016 |
| CN | 205259939 | U | 5/2016 |
| CN | 205259940 | U | 5/2016 |
| CN | 206309392 | U | 7/2017 |
| CN | 107620568 | A | 1/2018 |
| CN | 107654190 | A | 2/2018 |
| CN | 107882503 | A | 4/2018 |
| CN | 207420446 | U | 5/2018 |
| CN | 207420447 | U | 5/2018 |
| DE | 19641922 | C1 | 10/1997 |
| DE | 10150904 | C1 | 7/2003 |

* cited by examiner

PROCESS AND DEVICE FOR SUPPORTING ANCHOR BOLT AND ANCHOR CABLE ON SUCCESSIVE MINING WORKING FACE

CROSS-REFERENCE TO RELATED APPLICATION(S)

The present disclosure is a national stage application of International Patent Application No. PCT/CN2018/111871, which is filed on Oct. 25, 2018 and claims priority to Chinese Patent Application No. 201711079978.1, filed on Nov. 6, 2017, Chinese Patent Application No. 201711078992.X, filed on Nov. 6, 2017 and Chinese Patent Application No. 201711080738.3, filed on Nov. 6, 2017, the contents of which are hereby incorporated by reference in its entirety.

TECHNICAL FIELD

The present disclosure belongs to a field of manufacturing and application of coal mine roadway support equipment, and more particularly, to a process for supporting an anchor bolt and an anchor cable on a continuous mining working face.

BACKGROUND

At present, the main support forms of coal mine roadways in China are anchor bolt and anchor cable supports. Top, anchor bolts have been mechanically supported, mainly with a two-arm or four-arm anchor bolt drill carriage. Side anchor bolt and top anchor cable supports of a driving working face roadway of the entire continuous miner still need manual holding of a coal electric drill or a single-arm hydraulic drill machine, which is in a semi-mechanized backward operation state.

The side anchor bolt and top anchor cable supports mainly have the following problems: (1) the side anchor bolt support needs to be divided into left-side punching support and right-side punching support, which occupies more labor; (2) the side anchor bolt support needs scaffolding and operates at high place of the roadway, which is high in labor intensity and has more hidden risks; (3) the top anchor cable support generally adopts a non-anti-explosion agricultural carriage with a single-arm drill machine for punching support, which also is high in labor intensity and has more hidden risks; (4) since the support processes such as top anchor bolt support, side anchor bolt support and top anchor cable support need to be continuously completed in different stages, there are often the accidents such as coal side caving and roof caving caused by the fact that the side anchor bolts and the top anchor cables of a continuous mining working face in bad geological conditions cannot be supported in time.

It can be seen from this that the above anchor bolt and anchor cable supports for the continuous mining working face known to inventors obviously still have inconveniences and defects in equipment and methods, and further improvement is urgently needed. How to create a new fully mechanized process and equipment for supporting an anchor bolt and an anchor cable on a continuous mining working face with fewer people, high support efficiency and safety guarantee has become a goal that the industry urgently needs to improve.

SUMMARY

Some embodiments of the present disclosure provide a fully mechanized process for supporting an anchor bolt and an anchor cable with fewer people, high support efficiency and safety guarantee for a double-roadway drilling working face of a continuous miner.

To achieve the above object, some embodiments of the present disclosure adopt the following technical solutions.

In a process and equipment for supporting an anchor bolt and an anchor cable on a continuous mining working face, a four-arm top anchor bolt drill carriage serves as a front carriage, a six-arm side anchor bolt and top anchor cable drill carriage serves as a rear carriage, and the two carriages are arranged in a front-rear direction to work in parallel. Four anchor bolt drill machines of the four-arm top anchor bolt drill carriage form a top anchor bolt drill machine set, and toward a top plate for roadway top anchor bolt support. The front and rear parts of the six-arm side anchor bolt and top anchor cable drill carriage are provided with two side anchor bolt drill machines separately, four corners of a working platform are provided with a side anchor bolt drill machine separately, which form a side anchor bolt drill machine set facing a coal side for anchor bolt support of two sides of the roadway. Two top anchor cable drill machines are disposed in a middle of the six-arm side anchor bolt and top anchor cable drill carriage to form a top anchor cable drill machine set, and toward the top plate for top anchor cable reinforced support.

In an exemplary embodiment, the front carriage completes top anchor bolt support in a sequence of row 1, row 2, row 3, row 4, row 5, row 6, row 7, and row 8 every time traveling for 8 steps, and the rear carriage completes side anchor bolt support in a sequence of rows 1 and 5, rows 2 and 6, rows 3 and 7, and rows 4 and 8 every time traveling for 4 steps. Under good roadway roof conditions, the front carriage travels for a multiple (16) of 8 at a time. At this moment, the rear carriage travels for 8 steps in a support sequence of rows 1 and 5, rows 2 and 6, rows 3 and 7, rows 4 and 8, rows 9 and 13, rows 10 and 14, rows 11 and 15, and rows 12 and 16.

In an exemplary embodiment, a "two-carriage N-row" operation method is adopted, the two carriages have the same row spacing (about 1 m), and the N rows may be 8 or 16 rows. N is a natural number above 8 all within the protection scope of the solution. The specific value of N is determined by a user according to the stability of the top plate.

In an exemplary embodiment, N rows serve as an operation cycle, and after an operation cycle of support operation is completed, the front carriage, the rear carriage and a continuous miner of another roadway exchange positions, and enter another dug roadway for a next anchor bolt and anchor cable support cycling operation.

In an exemplary embodiment, every time traveling for one step, the four anchor bolt drill machines of the front carriage may work at the same time to complete supporting of four top anchor bolts; or, every time traveling for one step, supporting is performed for two times, the four anchor bolt drill machines first work at the same time to complete supporting of four top anchor bolts, then anchor bolt drill machines on both sides are stretched outwards by sliding of a slide box to complete support of two top anchor bolts near a coal side, and support of a total of six top anchor bolts in a row is completed.

In an exemplary embodiment, the four side anchor bolt drill machines of the rear carriage are disposed in the front and in the rear in pairs, a center distance of the front and rear side anchor bolt drill machines is adjustable, an adjustment range is 3.8-4.2 m, each side anchor bolt drill machine lifts up and down relative to guide friction pairs of a slide box and a fixed connecting body, and a maximum lifting height is 1 m. The sliding slide boxes in the slide boxes slides outwards by 0.5 m relative to the fixed slide box, so that the side anchor bolt drill machine meets side anchor bolt support requirements of different roadway widths. Each side anchor bolt drill machine lifts up and down for 1 m, and the working platform also drives the side anchor bolt drill machine to lift up and down for 1 m, so that each side anchor bolt drill machine lifts for 2 m from a lowest height to a highest height. Each side anchor bolt drill machine performs horizontal support for three side anchor bolts in a lifting height range of 2 m. If the side anchor bolt drill machine rotates at a certain angle upward or downward, a support task for four side anchor bolts is completed. Therefore, the four side anchor bolt drill machines complete a support task for two rows of 12-16 side anchor bolts every time the rear carriage travels forward for one step.

In an exemplary embodiment, for two top anchor cable drill machines arranged in the middle position of the rear carriage, a slide box structure is composed of a fixed slide box and two sliding slide boxes, the sliding slide boxes slide outwards by 0.5 m respectively relative to the fixed slide box, and two top anchor cable drill machines fixed on the sliding slide boxes face the top plate for top anchor cable reinforced support.

With the above technical solution, some embodiments of the present disclosure have at least the following beneficial effects.

1. The six-arm side anchor bolt and top anchor cable drill carriage involved in an embodiment of the present disclosure makes the anchor bolt and anchor cable support of a continuous mining roadway from semi-mechanized operation to fully mechanized operation, and provides basic equipment for a "two-carriage N-row" operation method support process. Through the "two-carriage N-row" operation method support process of parallel operation of the front and rear carriages, one-time mechanized support of three processes for top anchor bolts, side anchor bolts and top anchor cables is realized.

2. The number of workers is greatly reduced: for interrupted completion of two-side anchor bolt support at present, three people are required for left and right sides, three people are required for anchor cable support, and nine people are required for three operation points. But the newly developed six-arm side anchor bolt and top anchor cable drill carriage is operated by only four people, and the number of required people is less than half of people in the art known to inventors.

3. The support efficiency is greatly improved: when the six-arm side anchor bolt and top anchor cable drill carriage involved in an embodiment of the present disclosure supports side anchor bolts and top anchor cables, the support efficiency is improved by above 50% compared to manual holding of a single-arm electric coal drill.

4. The safety is further guaranteed: the side anchor bolt support does not need scaffolding for operating at high place of the roadway; the top anchor cable support does not need to use a non-anti-explosion agricultural carriage with a single-arm drill machine for punching support, which also is high in labor intensity and has more hidden risks; and the side anchor bolts and the top anchor cables of a continuous mining working face in bad geological conditions are supported in time to avoid the accidents such as coal side caving and roof caving.

BRIEF DESCRIPTION OF THE DRAWINGS

In order to more clearly understand the technical means of the present disclosure, some embodiments of the present disclosure will be further described in detail with reference to the accompanying drawings and specific implementations.

FIG. 1*a* is top anchor bolt support at a right roadway by a four-arm top anchor bolt drill carriage 3.1 and mining of a continuous miner 3.3 at a left roadway. FIG. 1*b* illustrates a schematic diagram of a device entering another cycle and then exchanging positions for continuous operation.

FIG. 2*a* is top anchor bolt support, side anchor bolt support and top anchor cable support at a right roadway by a four-arm top anchor bolt drill carriage 3.1 and a six-arm side anchor bolt and top anchor cable drill carriage 3.2, and mining of a continuous miner 3.3 at a left roadway. FIG. 2*b* illustrates a schematic diagram of a device entering another cycle and then exchanging positions for continuous operation.

Figure 1:
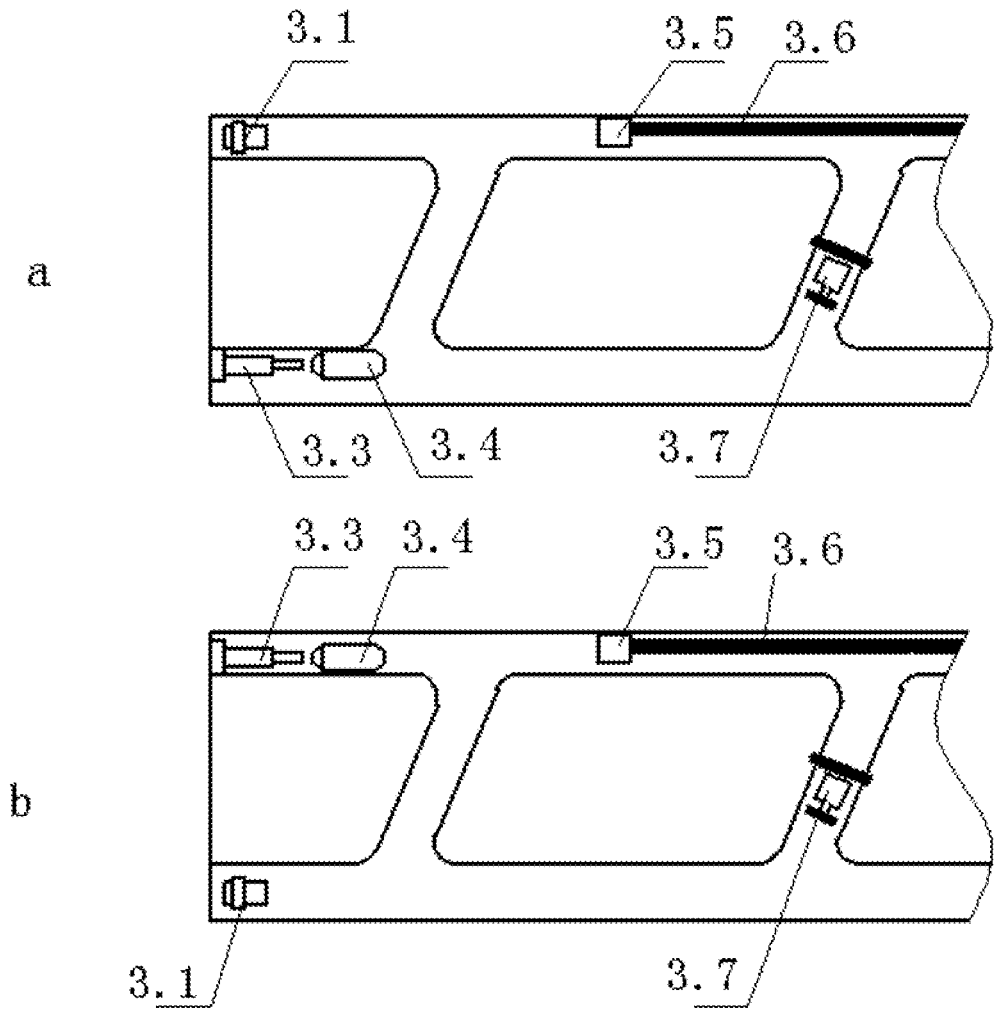
Prior Art Fig. 1
FIG. 1 is a construction process of a continuous mining working face known to inventors.

In the drawings: 1, crawler traveling body portion; 2, anchor bolt support working portion; 3, lifting oil cylinder; 4, guide column; 5, guide sleeve; 1.1, hydraulic power system; 1.2, dust cleaning box component; 1.3, electrical system; 1.4, cooling system; 1.5, cable winding system; 1.6, silencer box; 1.7, dust cleaning power device; 2.1, working platform; 2.1.1, fixed platform; 2.1.2, pedal; 2.1.3, turning oil cylinder; 2.2, translational slide box; 2.2.1, fixed slide box; 2.2.2, sliding slide box; 2.3, four anchor bolt drill machines; 2.4, hopper component; 2.4.1, hopper support frame; 2.4.2, main hopper; 2.4.3, auxiliary hopper; 2.5, temporary support oil cylinder; 2.5.1, upper support oil cylinder; 2.5.2, lower support oil cylinder; 2.6, cyclone component; 2.7, ceiling component; 2.7.1, lifting sleeve; 2.7.2, ceiling lifting oil cylinder; 2.7.3, ceiling; 2.7.4, telescopic beam; 2.7.5, telescopic oil cylinder;

2.2.3, front wear-resistant copper bar; 2.3.0, rear translational slide box; 2.3.1, rear fixed slide box; 2.3.2, rear sliding slide box; 2.3.3, rear wear-resistant copper bar; 2.4, hopper component; 2.6.0, adjustment oil cylinder;

3.1, four-arm top anchor bolt drill carriage; 3.2, six-arm side anchor bolt and top anchor cable drill carriage; 3.3, continuous miner; 3.4, shuttle carriage; 3.5, feeding crusher; 3.6, belt conveyor; 3.7, forklift; 3.8, supported side anchor bolt; 3.9, top anchor bolt drill machine; 3.10, front drill machine; 3.11, rear drill machine; 3.12, top anchor cable drill machine;

4.10, upper drill machine; 4.11, lower drill machine.

DETAILED DESCRIPTION OF THE EMBODIMENTS

It is to be noted that embodiments in the present application and characteristics in the embodiments may be combined under the condition of no conflicts. The present disclosure is described below with reference to the drawings and in conjunction with the embodiments in detail.

It is to be noted that terms used herein only aim to describe specific implementation manners, and are not intended to limit exemplar implementations of this application. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

It is to be noted that the specification and claims of the present application and the terms "first", "second" and the like in the drawings are used to distinguish similar objects, and do not need to describe a specific sequence or a precedence order. It will be appreciated that the terms used in such a way may be exchanged under appropriate conditions, in order that the embodiments of the present application described here can be implemented in, for example, a sequence other than sequences graphically shown or described here. In addition, terms "include" and "have" and any variations thereof are intended to cover non-exclusive inclusions. For example, it is not limited for processes, methods, systems, products or devices containing a series of steps or units to clearly list those steps or units, and other steps or units which are not clearly listed or are inherent to these processes, methods, products or devices may be included instead.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

Exemplary implementations in accordance with the present application will now be described in more detail with reference to the accompanying drawings. However, the exemplary implementations may be embodied in many different forms and should not be construed as being limited to the implementations set forth herein. It is to be understood that the implementations are provided so that the disclosure of the present application will be thorough and complete, and the concept of the exemplary implementations will be fully conveyed to those of ordinary skill in the art, in which the thicknesses of the layers and regions may be expanded for the sake of clarity, the same device is denoted by the same reference numerals, and the description thereof will be omitted.

Figure 2:
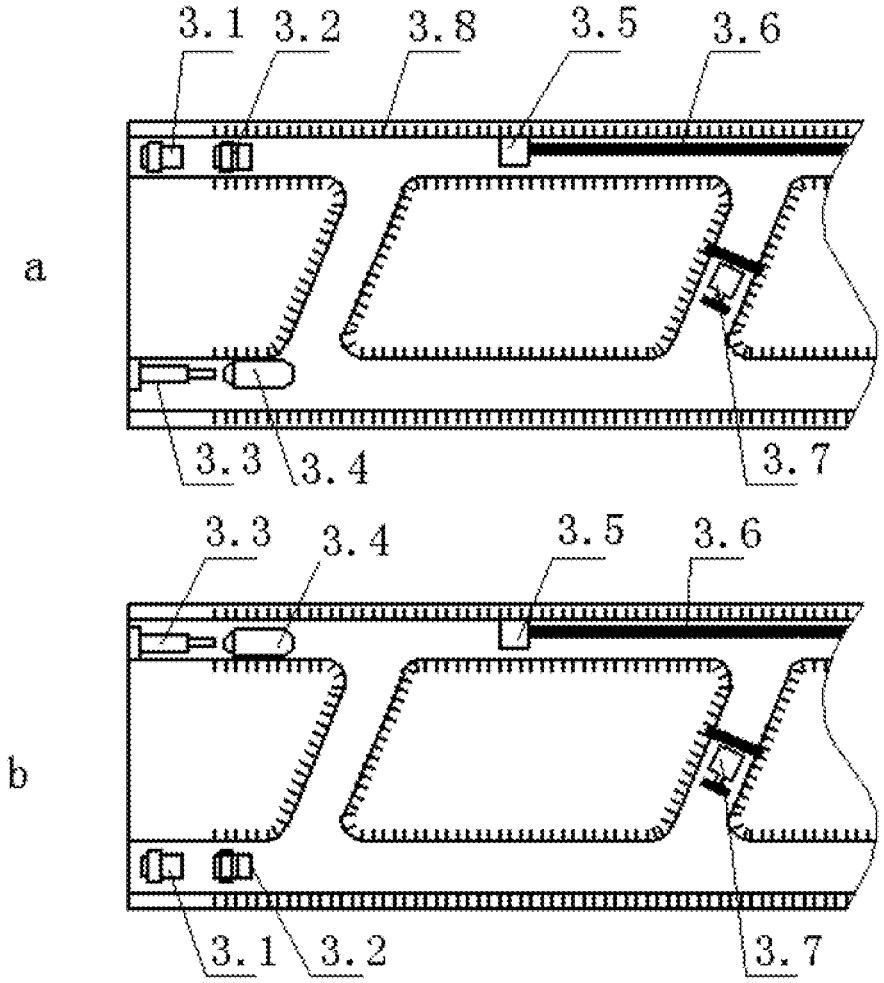
FIG. 2 is a construction process of an embodiment of the present disclosure.

As shown in FIG. 1, equipment used in a construction process of a continuous mining working face known to inventors is composed of a four-arm top anchor bolt drill carriage 3.1, a continuous miner 3.3, a shuttle carriage 3.4, a feeding crusher 3.5, a belt conveyor 3.6, and a forklift 3.7. FIG. 1*a* is top anchor bolt support at a right roadway by a four-arm top anchor bolt drill carriage 3.1 and mining of a continuous miner 3.3 at a left roadway. FIG. 1*b* is a schematic diagram for continuing to complete their respective work after the four-arm top anchor bolt drill carriage 3.1 and continuous miner 3.3 exchange positions. As shown in FIG. 2, the present disclosure relates to a process for supporting an anchor bolt and an anchor cable on a continuous mining working face, which is a support process formed by adding a six-arm side anchor bolt and top anchor cable drill carriage 3.2 on the basis of the equipment used in the construction process known to inventors. The support process of the present disclosure is used in conjunction with equipment such as the continuous miner 3.3 and the shuttle carriage 3.4 for the continuous mining working face, which greatly improves the driving efficiency of the continuous mining working face.

As shown in FIG. 2, two drill carriages with different functions are arranged in a front-rear direction, the four-arm top anchor bolt drill carriage 3.1 is a front carriage mainly used for top anchor bolt support, the six-arm side anchor bolt and top anchor cable drill carriage 3.2 is a rear carriage mainly used for side anchor bolt and top anchor cable support, and the front and rear carriages work in parallel.

Figure 3:
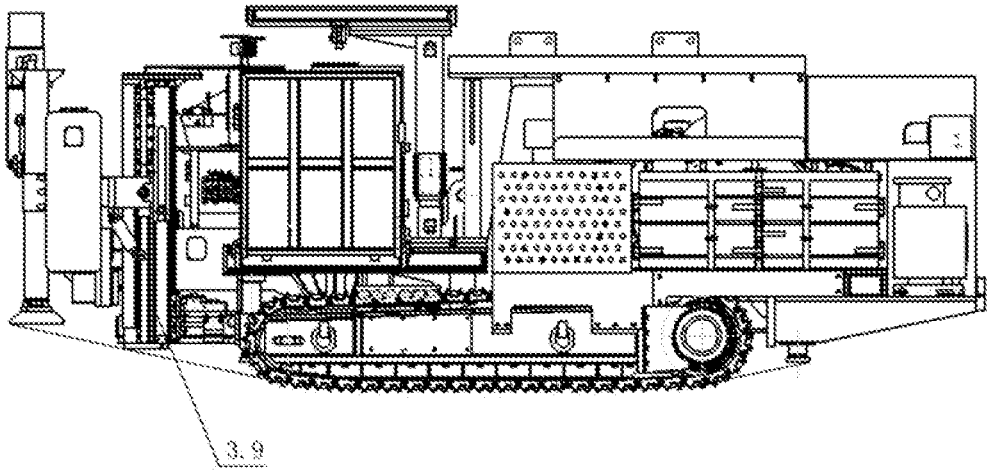
FIG. 3 illustrates a front view of a four-arm top anchor bolt drill carriage (front carriage) involved in an embodiment of the present disclosure.

As shown in FIG. 3, four anchor bolt drill machines 3.9 of the front carriage (four-arm top anchor bolt drill carriage 3.1) are arranged in a straight line, and drill arms face to a top plate. In an embodiment, the four anchor bolt drill machines 3.9 work at the same time to complete supporting of four top anchor bolts. In another embodiment, the four anchor bolt drill machines 3.9 perform support for two times. That is, the four anchor bolt drill machines 3.9 work at the same time to complete supporting of four top anchor bolts, and then the top anchor bolt drill machines on both sides are stretched outwards through a telescopic device to complete supporting of two top anchor bolts near a coal side, and a support task of a row of six top anchor bolts is completed.

Figure 4:
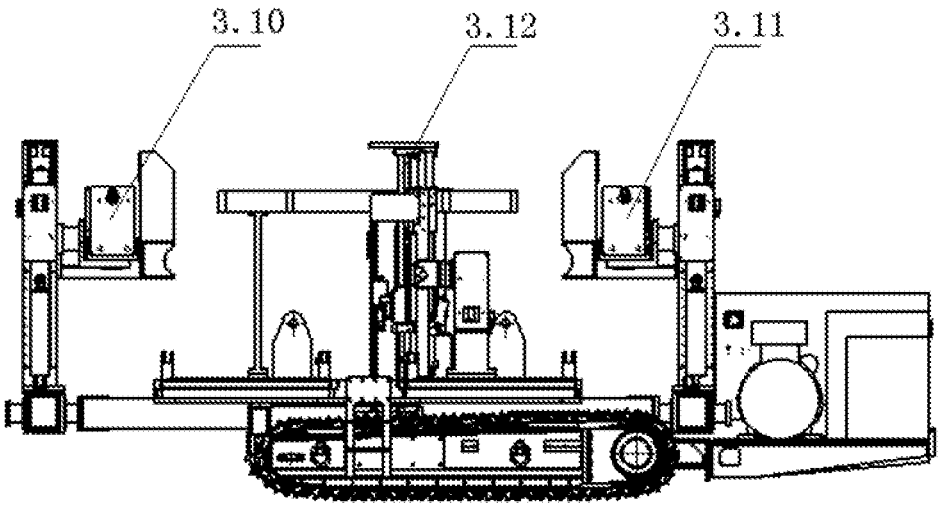
FIG. 4 illustrates a front view of a side anchor bolt support state of a six-arm side anchor bolt and top anchor cable drill carriage (rear carriage) involved in an embodiment of the present disclosure.
Figure 5:
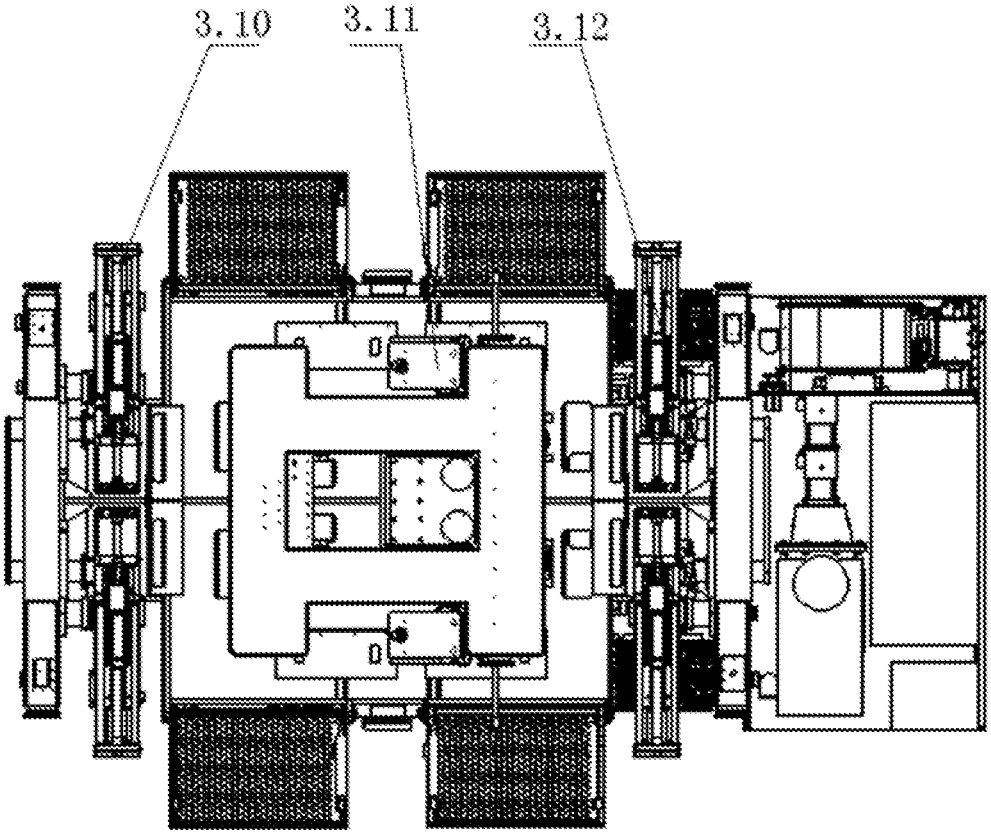
FIG. 5 illustrates a top view of FIG. 4.
Figure 7:
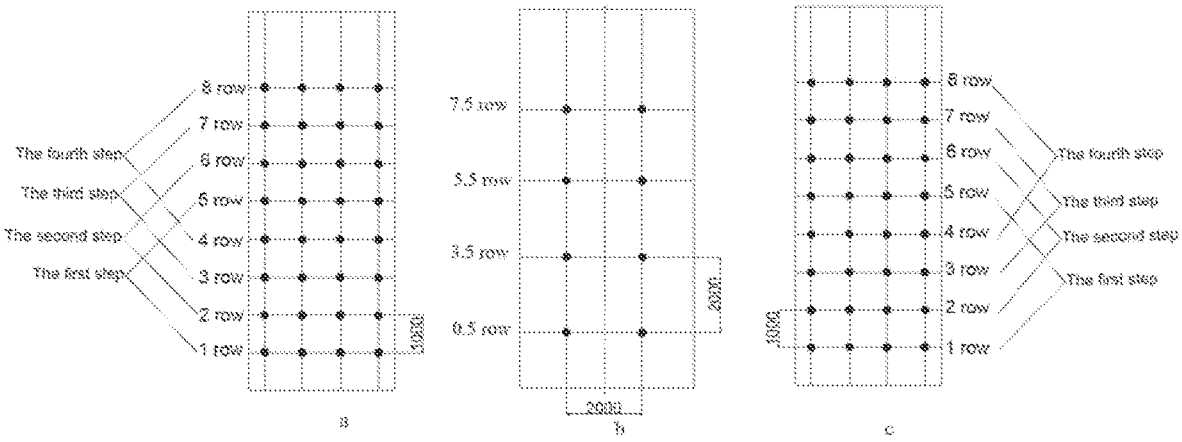
FIG. 7 illustrates a layout view of a left side anchor bolt, a top anchor cable and a right side anchor bolt of a six-arm side anchor bolt and top anchor cable drill carriage (rear carriage) involved in an embodiment of the present disclosure.

As shown in FIG. 4, FIG. 5 and FIG. 7, front and rear parts of the rear carriage are provided with four drill machines, which are horizontally disposed on a working platform in pairs in a front-rear direction (front drill machine 3.10 and rear drill machine 3.11) and respectively toward coal sides on both sides of the roadway. The four drill machines lift by 1 m, and the working platform also lift by 1 m. Therefore, when the drill machines lift by 2 m in a certain rotation angle range, every time traveling for one step, each of the four side anchor bolt drill machines completes a support task of 3-4 side anchor bolts, the four side anchor bolt drill machines complete a support task of two rows of 12-16 side anchor bolts.

As shown in FIG. 4 and FIG. 5, two top anchor cable drill machines 3.12 are disposed in a middle of the rear carriage, the top anchor cable drill machines are fixed on a slide box, the slide box is composed of a fixed slide box and two sliding slide boxes, the two sliding slide boxes slide outwards by 0.5 m respectively relative to the fixed slide box, and two top anchor cable drill machines fixed on the sliding slide boxes toward the top plate for top anchor cable reinforced support. Wherein, reference number 3.8 in the figure is a supported side anchor bolt.

As shown in FIG. 2*a*, the front carriage cooperates with the rear carriage, the front carriage completes top anchor bolt support in a sequence of row 1, row 2, row 3, row 4, row 5, row 6, row 7, and row 8 every time traveling for 8 steps, and the rear carriage completes side anchor bolt support in a sequence of rows 1 and 5, rows 2 and 6, rows 3 and 7, and rows 4 and 8 every time traveling for 4 steps. In the case of a row spacing of about 1 m, generally 8 m is an operation cycle.

As shown in FIG. 2*b*, in an embodiment, after completing an operation cycle, the front carriage, the rear carriage and the continuous miner 3.3 exchange positions for respective continuous operation.

Figure 6:
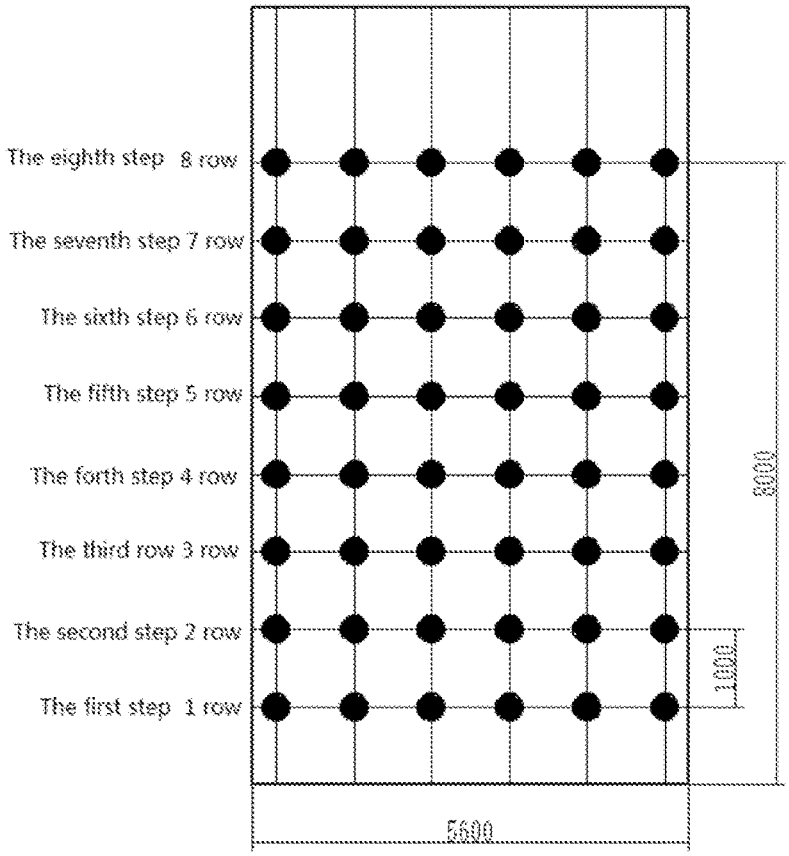
FIG. 6 illustrates a layout view of top anchor bolt support of a four-arm top anchor bolt drill carriage (front carriage) involved in an embodiment of the present disclosure.

As shown in FIG. 6 and FIG. 7, in an embodiment, the front carriage travels in a sequence of step 1, step 2, step 3, . . . , step 8, the rear carriage travels in a sequence of supporting side anchor bolts in rows 1 and 5 in the first step, supporting side anchor bolts in rows 2 and 6 in the second step, supporting side anchor bolts in rows 3 and 7 in the first step, and supporting side anchor bolts in rows 4 and 8 in the fourth step. After the rear carriage completes anchor bolt support, under sufficient conditions, it is necessary to complete reinforced support of a total of 8 top anchor cables in row 1.5, row 3.5, row 5.5, and row 7.5.

As shown in FIG. 6 and FIG. 7, the front and rear carriage support processes are collectively referred to as a "two-carriage eight-step" method support process, which realizes the one-time completion of three processes of for top anchor bolts, side anchor bolts and top anchor cables.

As shown in FIG. 6 and FIG. 7, the "two-carriage eight-step" method support process is not limited to traveling of the front and rear carriages for eight steps as a side anchor bolt support cycle. According to the stability of the roadway roof, under geological conditions of good roof, in an embodiment, a "two-carriage N-row" method support process is also used.

As shown in FIG. 2 and FIG. 3, the front carriage has a top anchor cable support function in addition to a top anchor bolt support function. When the number of side anchor bolts and top anchor cables required to be supported by the geological conditions is large, the workload of the rear carriage is greater than that of the front carriage. At this moment, the front carriage assists the rear carriage in supporting of a top anchor cable to ensure parallel operation of the front and rear carriages within nearly 100% of the time.

On the basis of the six-arm side anchor bolt and top anchor cable drill carriage newly developed in some embodiments of the present disclosure, a "two-carriage N-row" operation method support process of parallel operation of the front and rear carriages realizes one-time mechanized support of three processes of for top anchor bolts, side anchor bolts and top anchor cables, particularly realizes timely support of the side anchor bolts and the top anchor cables, and eliminates unsafe factors such as coal side caving and roof caving.

Figure 8:
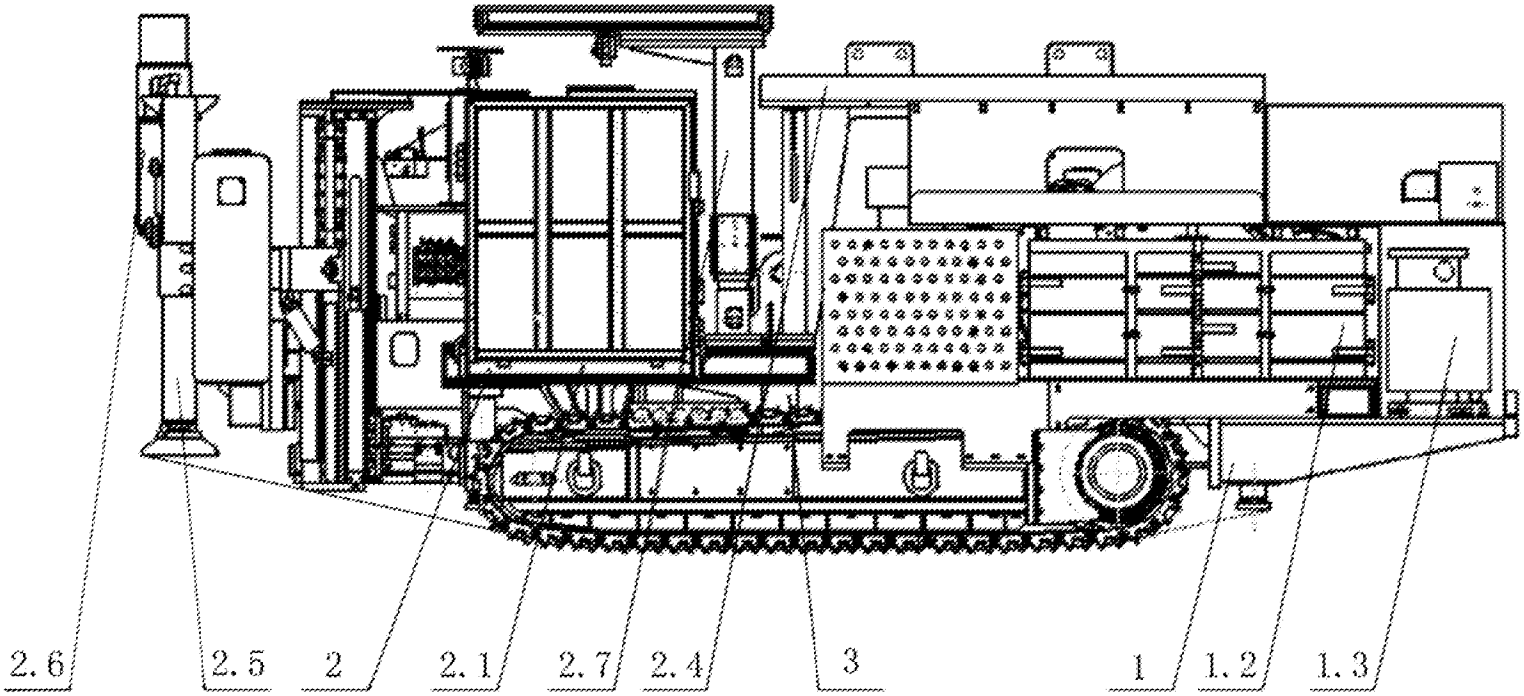
FIG. 8 illustrates a front view of a mining four-arm anchor bolt drill carriage according to an embodiment of the present disclosure.
Figure 10:
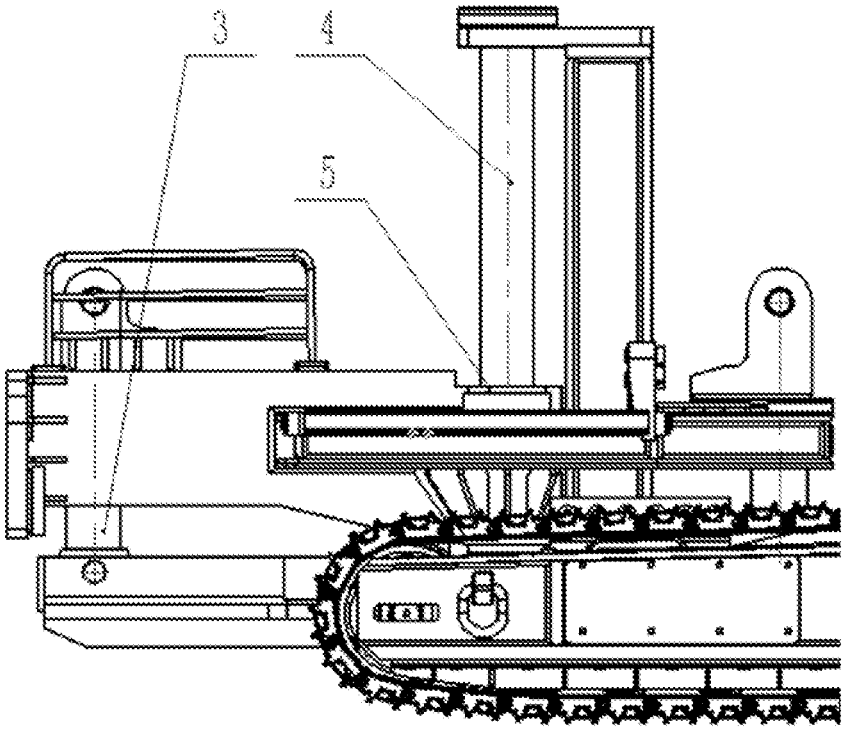
FIG. 10 illustrates a schematic diagram of a vertical lifting mechanism.

As shown in FIG. 8 and FIG. 10, a mining four-arm anchor bolt drill carriage of an embodiment of the present disclosure includes a crawler traveling body portion 1 and an anchor bolt support working portion 2. By means of a sliding friction pair composed of a guide column 4 and a guide sleeve 5, under the driving of a lifting oil cylinder 3, the crawler traveling body portion 1 is used as a fulcrum to push the anchor bolt support working portion 2 to vertically rise or fall, so as to meet working requirements of the anchor bolt support working portion at different heights. The vertical lifting structure may also be used for a six-arm anchor bolt drill carriage.

Figure 9:
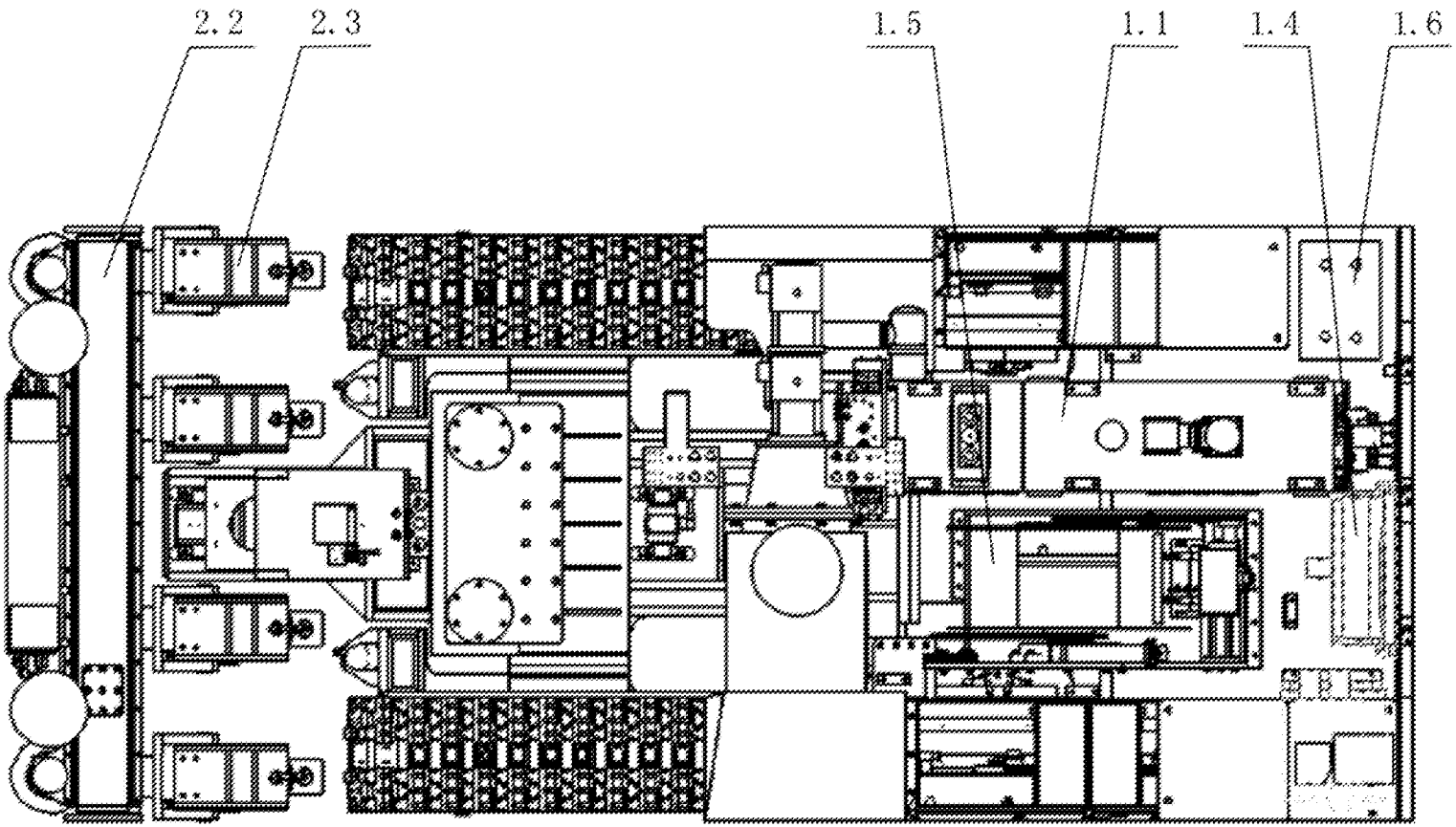
FIG. 9 illustrates a top view of FIG. 8.
Figure 14:
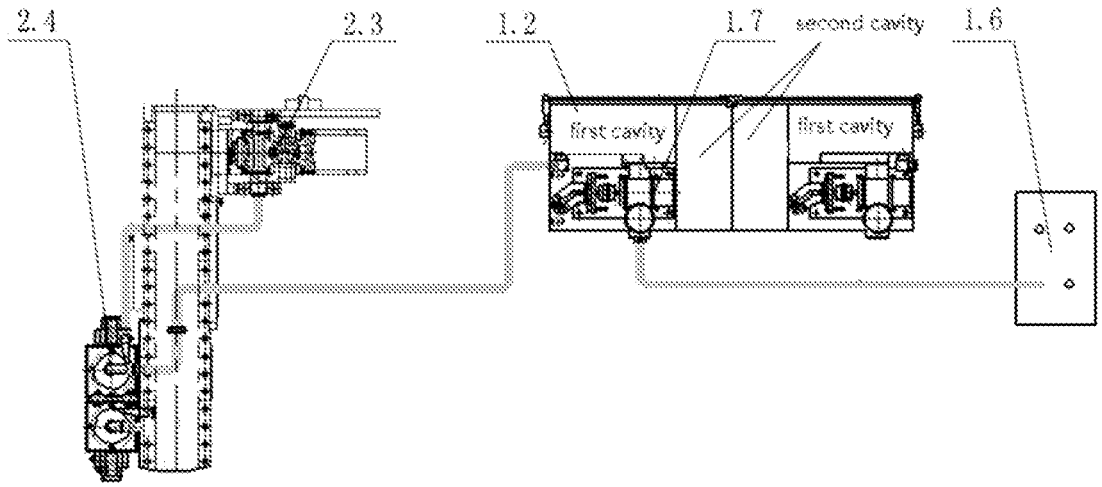
FIG. 14 illustrates a schematic diagram of a dust cleaning system.

As shown in FIG. 8, FIG. 9 and FIG. 14, in an embodiment, the crawler traveling body portion 1 includes a crawler frame and a body frame. The body frame of the crawler traveling body portion 1 is provided with a hydraulic power system 1.1, a dust cleaning box component 1.2, an electrical system 1.3, a cooling system 1.4, a cable winding system 1.5, a silencer box 1.6, and a dust cleaning power device 1.7. The anchor bolt support working portion 2 includes a working platform 2.1, a translational slide box 2.2, four anchor bolt drill carriages 2.3, a hopper component 2.4, a temporary support oil cylinder 2.5, a cyclone component 2.6, and a ceiling component 2.7.

Figure 13:
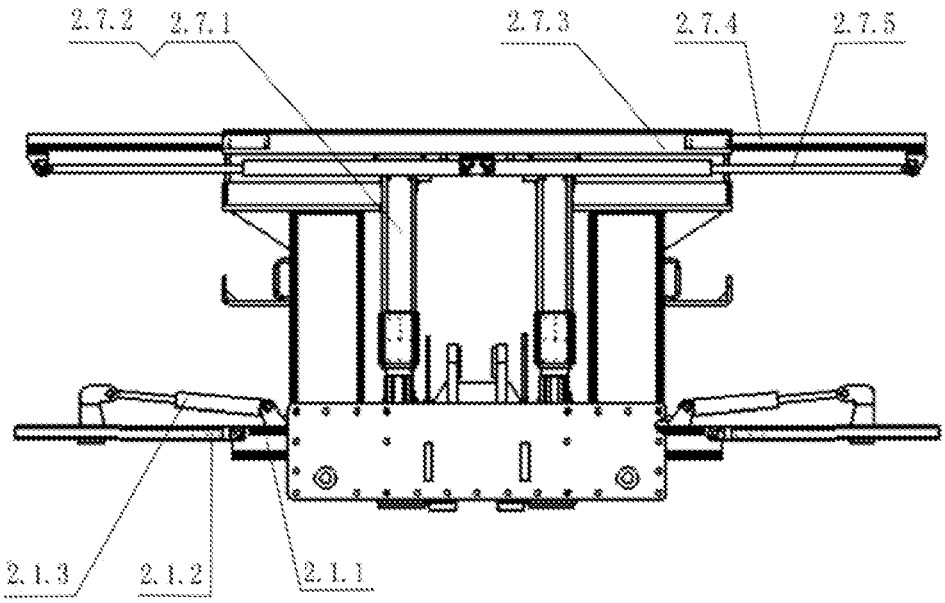
FIG. 13 illustrates a left view of FIG. 12.

As shown in FIG. 8 and FIG. 13, in an embodiment, pedals 2.1.2 are hinged to both sides of a fixed platform 2.1.1 of the working platform 2.1 of the anchor bolt support working portion 2, a turning oil cylinder 2.1.3 is installed between the fixed platform 2.1.1 and the pedals 2.1.2, a turning power of the pedals 2.1.2 is the turning oil cylinder 2.1.3, the pedals are flat in a horizontal state during working to ensure that an operator works near coal sides, and the pedals are retracted to be in a vertical state during traveling, so as to ensure that the body is in a narrowest state during traveling.

Figure 11:
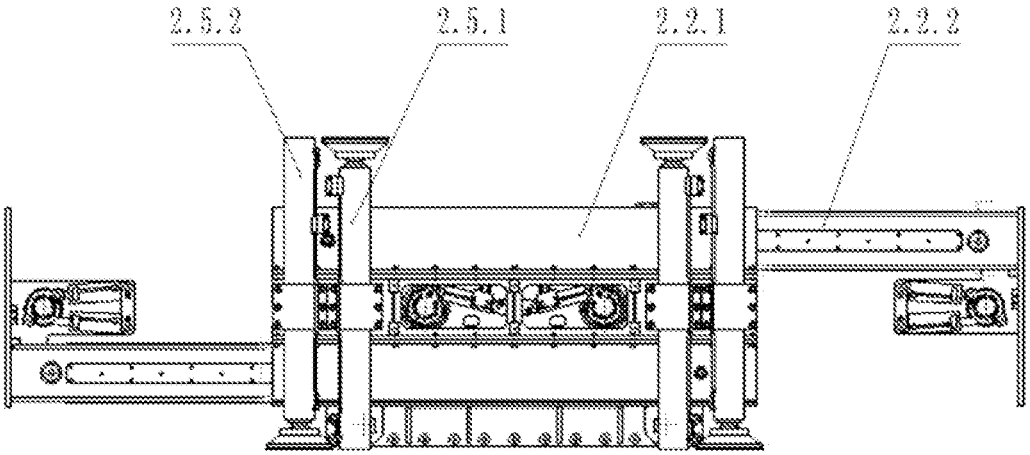
FIG. 11 illustrates a schematic diagram of a translational slide box and a temporary support oil cylinder.
Figure 12:
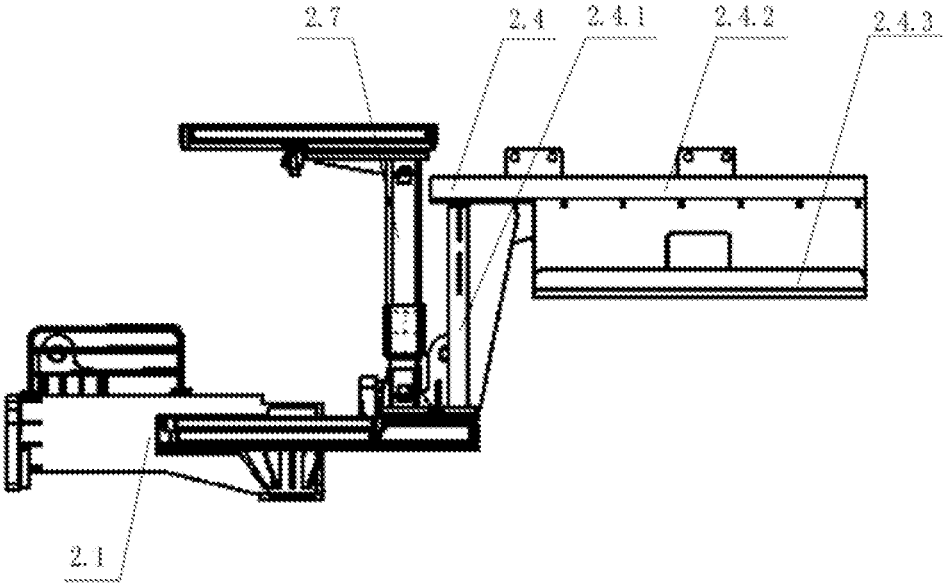
FIG. 12 illustrates a schematic diagram of a working platform component, a ceiling component and a hopper component.

As shown in FIG. 8 and FIG. 11, in an embodiment, the translational slide box 2.2 of the anchor bolt support working portion 2 includes a fixed slide box 2.2.1 and sliding slide boxes 2.2.2 slidably connected with both sides of the fixed slide box 2.2.1, a wear-resistant copper bar is fixed on an outer surface of each of the sliding slide boxes 2.2.2, and the outer surface of each of the sliding slide boxes 2.2.2 and an inner surface of the fixed slide box 2.2.1 form a rectangular sliding friction pair, and a clearance of the rectangular sliding friction pair is adjustable, so as to compensate for a new clearance formed after the two boxes are worn. In an embodiment, the temporary support oil cylinders 2.5 of the anchor bolt support working portion 2 are fixed on both sides of the front of the translational slide box 2.2 through a flat key and a bolt, and each of the temporary support oil cylinders 2.5 comprises two upper supporting oil cylinders 2.5.1 and two lower supporting oil cylinders 2.5.2, so that a reaction force of a top plate to the drill carriage is directly transmitted to a bottom plate through the upper and lower supporting oil cylinders. The temporary support oil cylinder 2.5 effectively supports the top plate to protect the operator, but the reaction force of the top plate on the drill carriage cannot be transmitted to other components of the drill carriage, otherwise the drill carriage is prone to tilt, causing potential safety hazards.

In an embodiment, as shown in FIG. 8, FIG. 9 and FIG. 11, the four anchor bolt drill machines 2.3 of the anchor bolt support working portion 2 are fixed on the translational slide box 2.2. The middle two anchor bolt drill machines in the four anchor bolt drill machines 2.3 are fixed on the fixed slide box 2.2.1 of the translational slide box 2.2. The lateral two anchor bolt drill machines in the four anchor bolt drill machines 2.3 are fixed on the sliding slide boxes 2.2.2 on both sides respectively. The sliding slide boxes 2.2.2 on both sides drive the two anchor bolt drill machines to extend for 1.35 m to both sides to ensure different spacing requirements of the top anchor bolts. The four anchor bolt drill machines are connected with the translational slide box 2.2 through an oil cylinder that can be rotated left and right and an oil cylinder that can be tilted back and forth, and all have the functions of left-right rotation and front-rear inclination, mainly for ensuring that anchor holes are always perpendicular to the top plate when inclining to the drill carriage under complex geological conditions.

In an embodiment, as shown in FIG. 8 and FIG. 13, the hopper component 2.4 of the anchor bolt support working portion 2 is composed of a hopper support frame 2.4.1, a main hopper 2.4.2 and an auxiliary hopper 2.4.3. The hopper support frame 2.4.1 is installed on the working platform 2.1. The main hopper 2.4.2 and the auxiliary hopper 2.4.3 are disposed on the hopper support frame 2.4.1 up and down to realize a left group and a right group. The auxiliary hopper 2.4.3 is 1.5 m-2.5 m away from the ground. In an embodiment, the lowest height is 1.5 m, which is convenient for feeding, and then materials in the auxiliary hopper 2.4.3 are conveyed to the main hopper 2.4.2 for the second time, and also serve as supplements of materials placed in the main hopper 2.4.2.

In an embodiment, as shown in FIG. 13 and FIG. 14, the ceiling component 2.7 is installed on an upper plane of the working platform 2.1 of the anchor bolt support working portion 2, a height of the ceiling is adjusted according to the height of the person, a lifting sleeve 2.7.1 is powered by a ceiling lifting oil cylinder 2.7.2, there are telescopic beams 2.7.4 on both sides of a ceiling 2.7.3 respectively, the extension and retraction of the telescopic beams 2.7.4 are controlled by power supplied by a telescopic oil cylinder 2.7.5, the telescopic beams retract when the drill carriage travels, and the telescopic beams extend when the drill carriage works.

As shown in FIG. 10, in an embodiment of the present disclosure, the crawler body portion 1 of the anchor bolt drill carriage is provided with a cooling system 1.4, which is cooled by air, and the imported hydraulic power system of the same type of anchor bolt drill carriage known to the inventors is cooled by natural cooling, the hydraulic oil temperature is higher in actual use, which has a greater impact on the service life of the main hydraulic components and various sealing links. Adding an air cooling system in an embodiment of the present disclosure will balance the hydraulic oil temperature at the most ideal temperature.

As shown in FIG. 8, FIG. 9 and FIG. 14, in an embodiment, the anchor bolt drill carriage dust cleaning system includes four dust cleaning power devices 1.7 (a negative pressure fan is used in the present embodiment), two dust cleaning box components 1.2, four cyclone components 2.6, one silencer box 1.6, and eight silencers installed in the silencer box 1.6. The dust cleaning box component 1.2 includes a first cavity and a second cavity. A filter device is disposed between the two cavities (a filter element is used in the present embodiment). The cyclone component 2.6 and the first cavity of the dust cleaning box component 1.2 are connected by a pipeline. An air suction port of the dust cleaning power device 1.7 is connected with the second cavity by a flange, and an air outlet is connected with the silencer by a pipeline. Under an action of the negative pressure fan of the dust cleaning power device 1.7, large particles in dust generated by drilling of the anchor bolt drill carriage 2.3 are dropped through a cyclone, which is the first-level dust cleaning; finer dust falls into the first cavity of the dust cleaning box through a box maze of the dust cleaning box, which is second-level dust cleaning; finer dust falls into the second cavity of the dust cleaning box by filtering through the filter element, which is third-level dust cleaning. Two silencers are connected with the negative pressure fan of each dust cleaning power device 1.7, and the working noise will be greatly improved compared to the imported anchor bolt drill carriage known to inventors.

As shown in FIG. 10, the cable winding system 1.5 adopts an ultra-large-diameter roller having a diameter of 1.35 m, is of a specification of 252 mm cable, and the winding length is 250 m, which is increased by 50 m compared to the imported anchor bolt drill carriage known to inventors.

In summary, the mining anchor bolt drill carriage of some embodiments of the present disclosure has innovatively designed a vertical lifting mechanism for the anchor bolt support working portion, which greatly reduces the minimum working height of the four anchor bolt drill carriages of a final execution mechanism and widens the range of adaptation of the anchor bolt drill carriages; the overall compact design reduces the width of the whole machine by 500 mm compared with similar imported equipment and increases the pedestrian space on both sides; the hydraulic power system adds an air cooling system to keep the hydraulic oil temperature within a reasonable range, especially suitable for double-roadway mining working face of a continuous miner.

Figure 15:
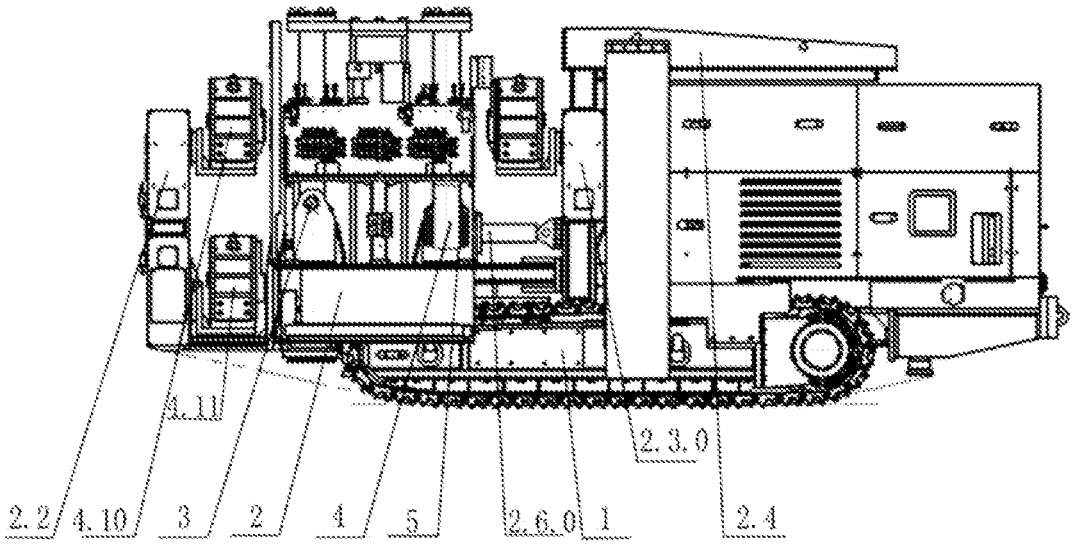
FIG. 15 illustrates a schematic structure diagram of a mining six-arm anchor bolt and anchor cable drill carriage according to an embodiment of the present disclosure.
Figure 16:
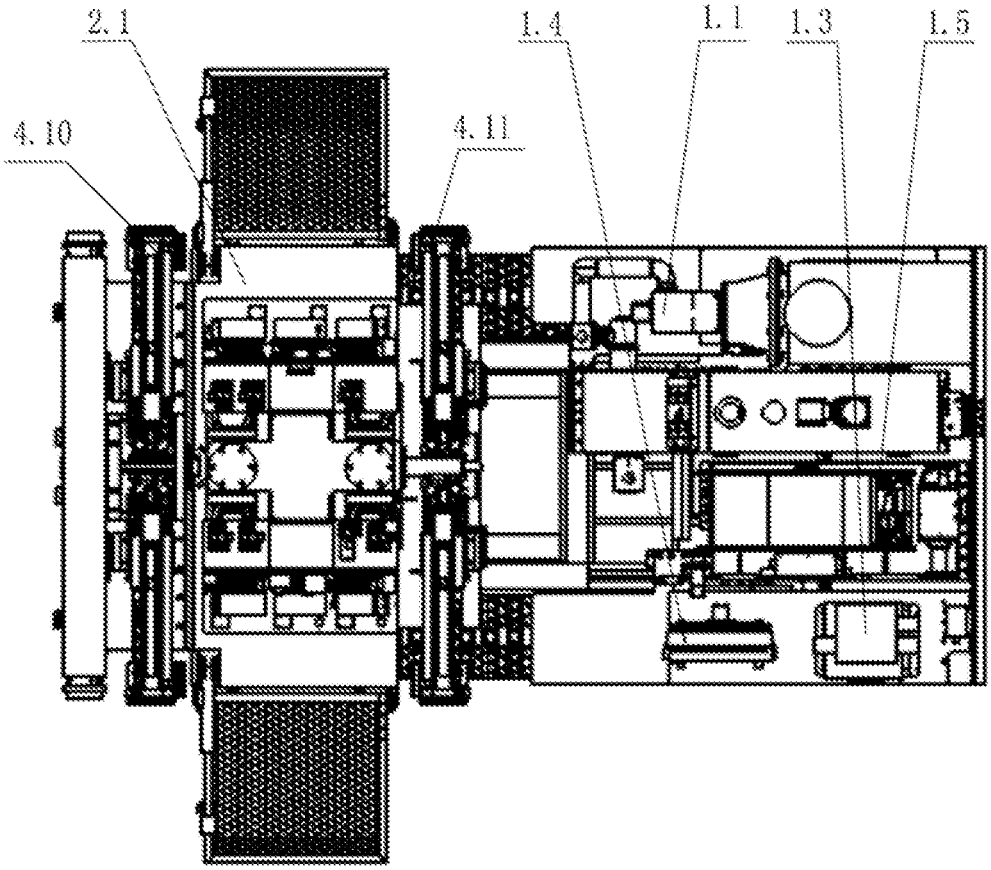
FIG. 16 illustrates a top view of FIG. 1.
Figure 17:
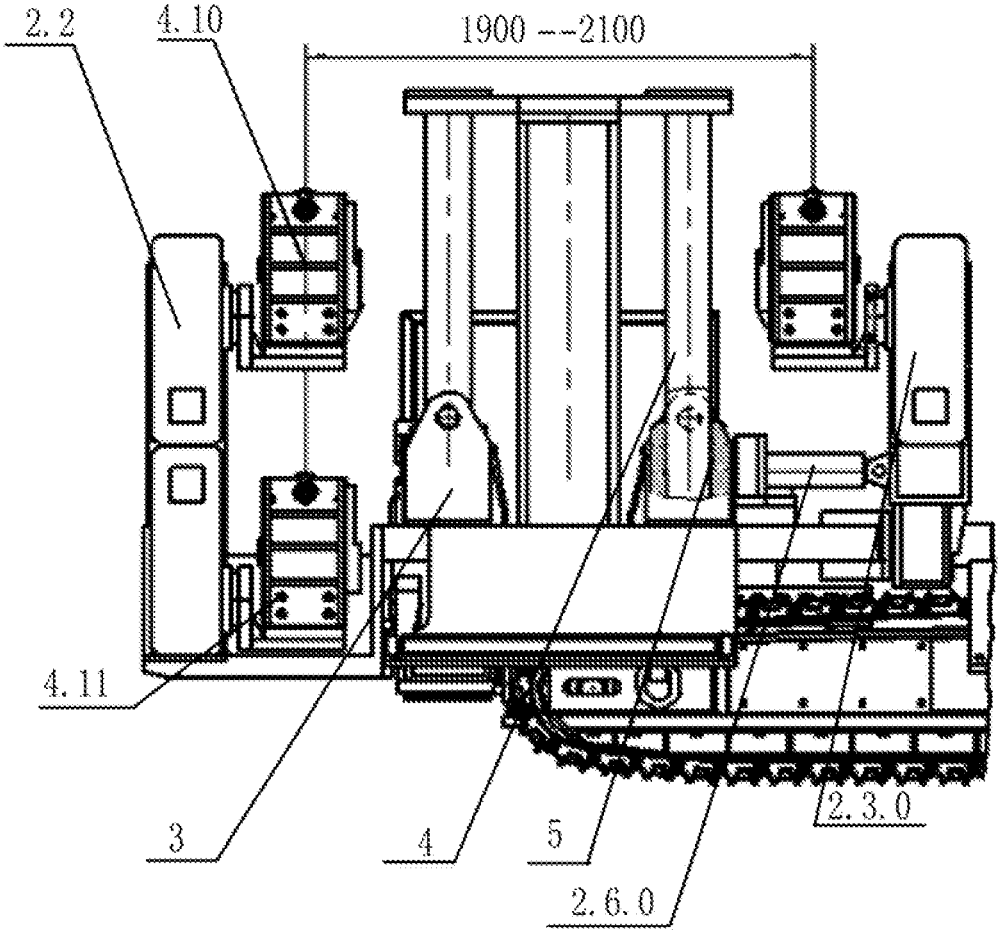
FIG. 17 illustrates a schematic diagram of a vertical lifting mechanism.

According to another embodiment of the present disclosure, as shown in FIG. 15, FIG. 16 and FIG. 17, a mining six-arm anchor bolt and anchor cable drill carriage includes a crawler traveling body portion 1 and an anchor bolt and anchor cable support working portion 2. The anchor bolt and anchor cable support working portion 2 includes a working platform 2.1 and six drill machines 2.4. The working platform 2.1 is connected by a sliding friction pair composed of a guide column 4 and a guide sleeve 5, and four lifting oil cylinders 3 are installed between the crawler traveling body portion 1 and the working platform 2.1. Under the driving of the four lifting oil cylinders 3, the crawler traveling body portion 1 is used as a fulcrum to push the anchor bolt and anchor cable support working portion 2 to vertically rise or fall, so as to meet working requirements of the anchor bolt and anchor cable support working portion at different heights. The above arrangement saves the space occupied by connecting rods of a four-linkage mechanism, makes the anchor bolt and anchor cable support working portion 2 close to the crawler traveling body portion 1, greatly reduces the minimum working height of six drill machines, and increases the adaptation range of the products.

In an embodiment, as shown in FIG. 15 and FIG. 16, the crawler traveling body portion 1 includes a crawler frame and a body frame. The body frame is provided with a hydraulic power system 1.1, an electrical system 1.3, a cooling system 1.4, a cable winding system 1.5, and other fixed facilities. The anchor bolt and anchor cable support working portion 2 includes a working platform 2.1, a front translational slide box 2.2, a rear translational slide box 2.3.0, six drill machines 2.4, a hopper component 2.4, and an adjustment oil cylinder 2.6.0.

Figure 18:
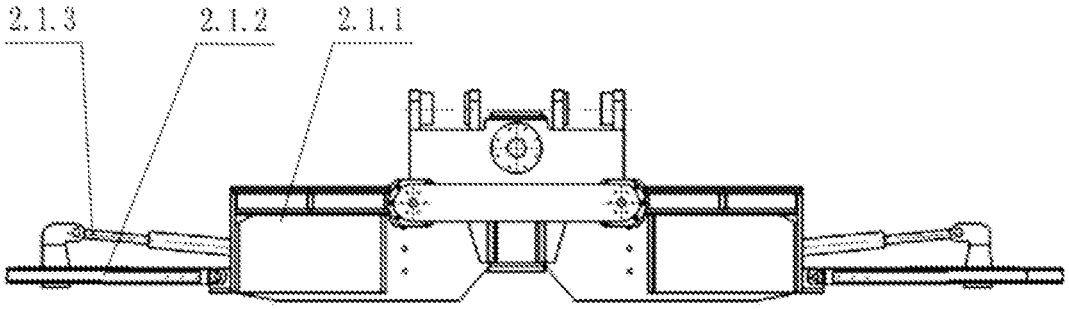
FIG. 18 illustrates a schematic diagram of a working platform.

In an embodiment, as shown in FIG. 18, pedals 2.1.2 are hinged to both sides of a fixed platform 2.1.1 of the working platform 2.1 of the anchor bolt and anchor cable support working portion 2, a turning oil cylinder 2.1.3 is installed between the fixed platform 2.1.1 and the pedals 2.1.2, a turning power of the pedals 2.1.2 is provided by the turning oil cylinder 2.1.3, the pedals 2.1.2 are flat in a horizontal state during working to ensure that an operator works near coal sides, and the pedals 2.1.2 are retracted to be in a vertical state during traveling to ensure that the body is in a narrowest state during traveling.

Figure 19:
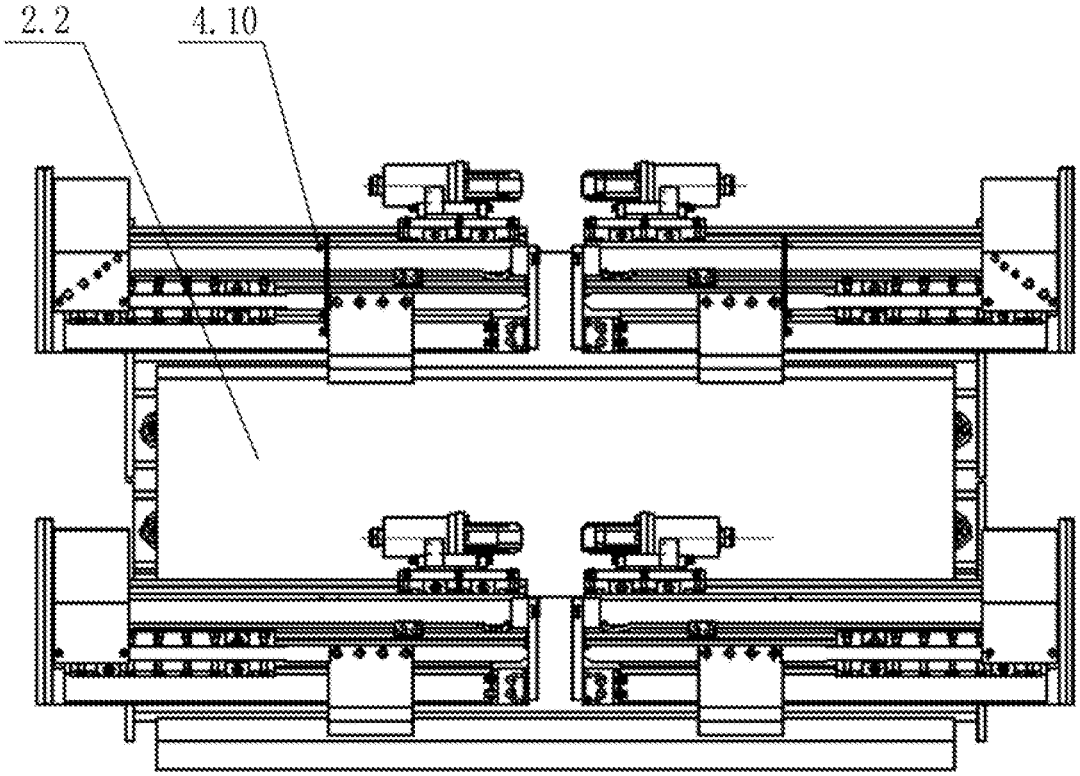
FIG. 19 illustrates a schematic diagram of a front translational slide box and a horizontal state of four drill machines.
Figure 20:
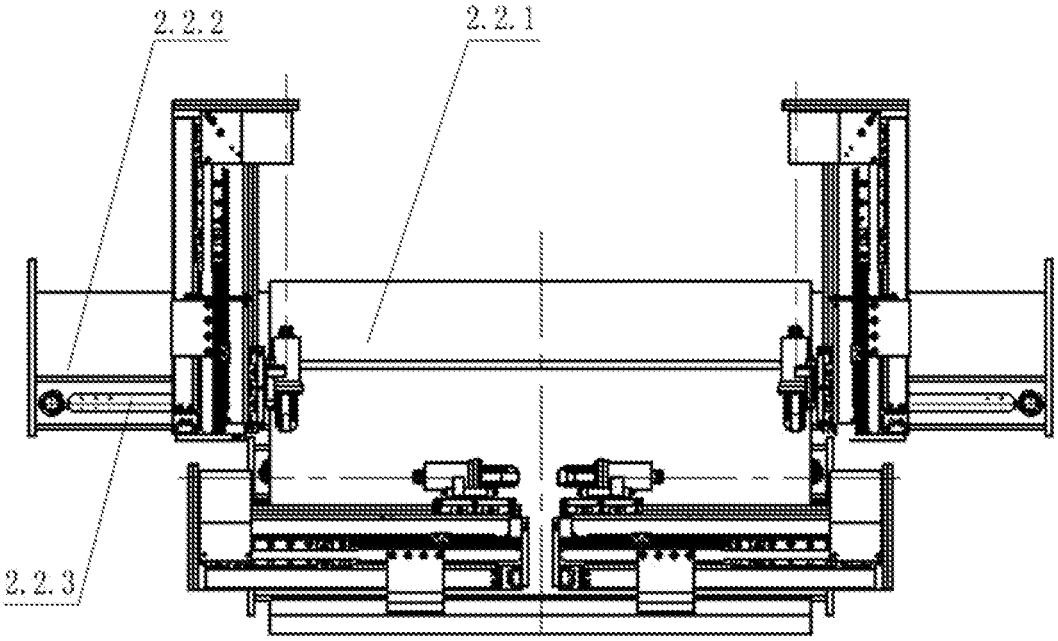
FIG. 20 illustrates a schematic diagram of a front translational slide box, a horizontal state of two drill machines, and a vertical state of two drill machines rotating by 90°.
Figure 21:
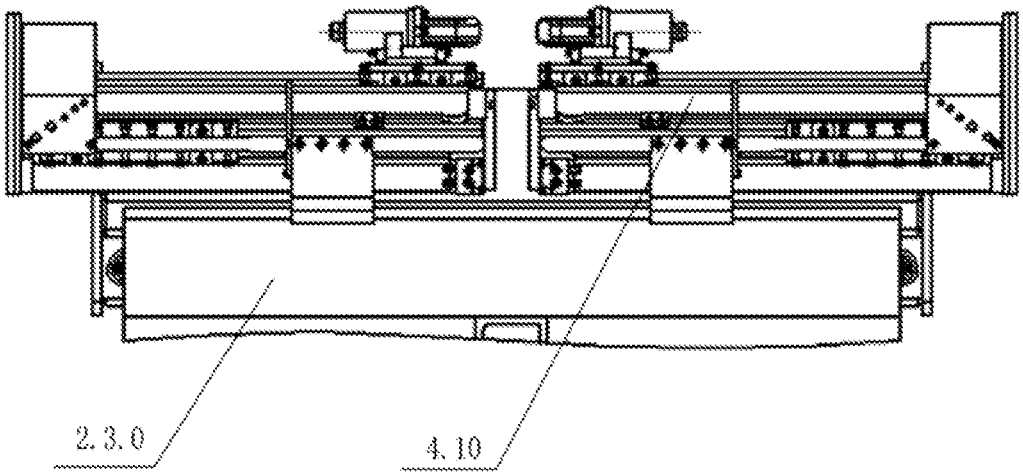
FIG. 21 illustrates a schematic diagram of a rear translational slide box and a horizontal state of two drill machines.
Figure 22:
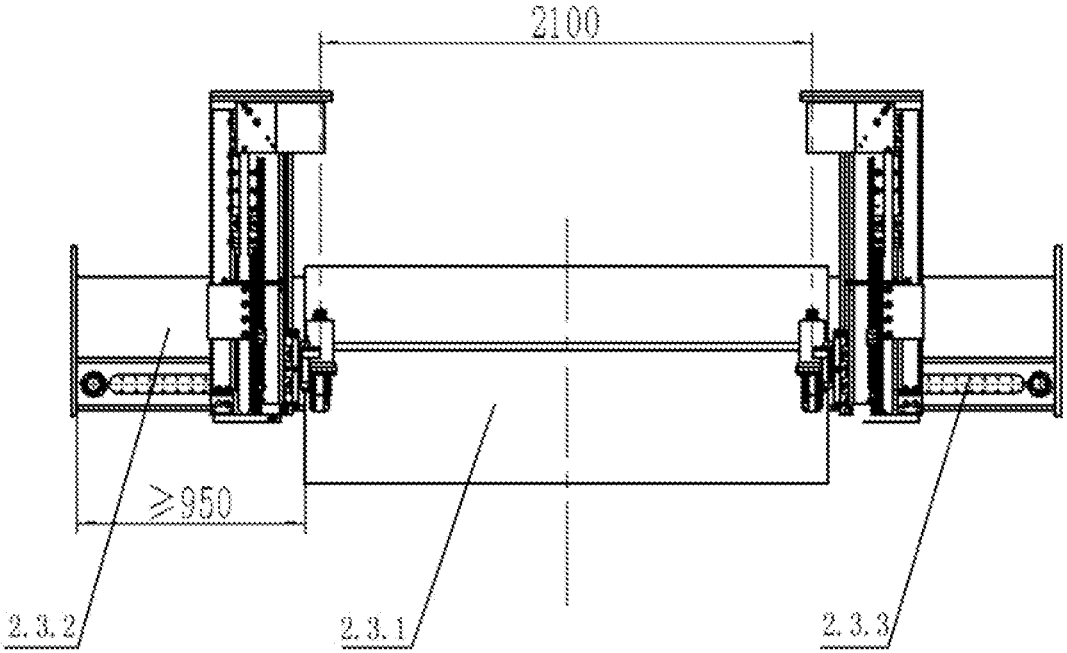
FIG. 22 illustrates a schematic diagram of a rear translational slide box and two drill machines rotating by 90° in a vertical state.

As shown in FIG. 19 and FIG. 20, the front translational slide box 2.2 of the anchor bolt and anchor cable support working portion 2 includes a front fixed slide box 2.2.1 and front sliding slide boxes 2.2.2 slidably connected with both sides of the front fixed slide box 2.2.1, and front sliding slide boxes 2.2.2 perform translational slide to both sides. Front wear-resistant copper bars 2.2.3 are fixed on outer surfaces of the front sliding slide boxes 2.2.2, an outer surface of each of the front sliding slide boxes 2.2.2 and an inner surface of the front fixed slide box 2.2.1 form a rectangular sliding friction pair, and a clearance therebetween is adjustable to compensate for a new clearance formed after the two boxes are worn. The front translational slide box 2.2 includes one front fixed slide box 2.2.1 and four front sliding slide boxes 2.2.2. The two front sliding slide boxes 2.2.2 on each side are disposed up and down. The four drill machines 2.4 are installed on the four front sliding slide boxes 2.2.2 respectively. In an embodiment, as shown in FIG. 21 and FIG. 22, the rear translational slide box 2.3.0 includes one rear fixed slide box 2.3.1 and two rear sliding slide boxes 2.3.2 connected with both sides thereof, and the two rear sliding slide boxes 2.3.2 perform translational slide to both sides. The two drill machines 2.4 are installed on the two rear sliding slide boxes 2.3.2 respectively. Each drill machine 2.4 can translate and slide to both sides by above 0.95 m to ensure that the drill machine works at different working positioning points.

In an embodiment, as shown in FIG. 19 and FIG. 20, two of the four drill machines 2.4 installed on the front translational slide box 2.2 are arranged on each side, and the drilling direction is toward the coal walls on both sides. Each drill machine 2.4 is installed on the corresponding sliding slide box through a rotating oil cylinder, and has the function of rotating up and down to accurately locate the drilling position. The drill machine 2.4 located below is rotated with reference of a horizontal direction by 25° downwards and 5° upwards to ensure the effective support of the lowermost side anchor bolt of the coal side and the fine adjustment of the drilling position of an anchor bolt hole. The drill machine 2.4 located above is rotated with reference of a horizontal direction by 5° downwards and more than 95° upwards to ensure the fine adjustment of the drilling position of an anchor bolt hole and the support of a top anchor cable when a drill rod is perpendicular to a top plate.

In an embodiment, as shown in FIG. 21 and FIG. 22, the rear translational slide box 2.3.0 is provided with two drill machines 2.4 on both sides, and the drilling direction is toward the top plate. Each drill machine 2.4 has the function of rotating left and right, and is rotated with reference of a vertical direction by 5° centrally and more than 95° outwards to ensure the assistance in the drill machine installed on the front translational slide box for side anchor bolt support.

Figure 23:
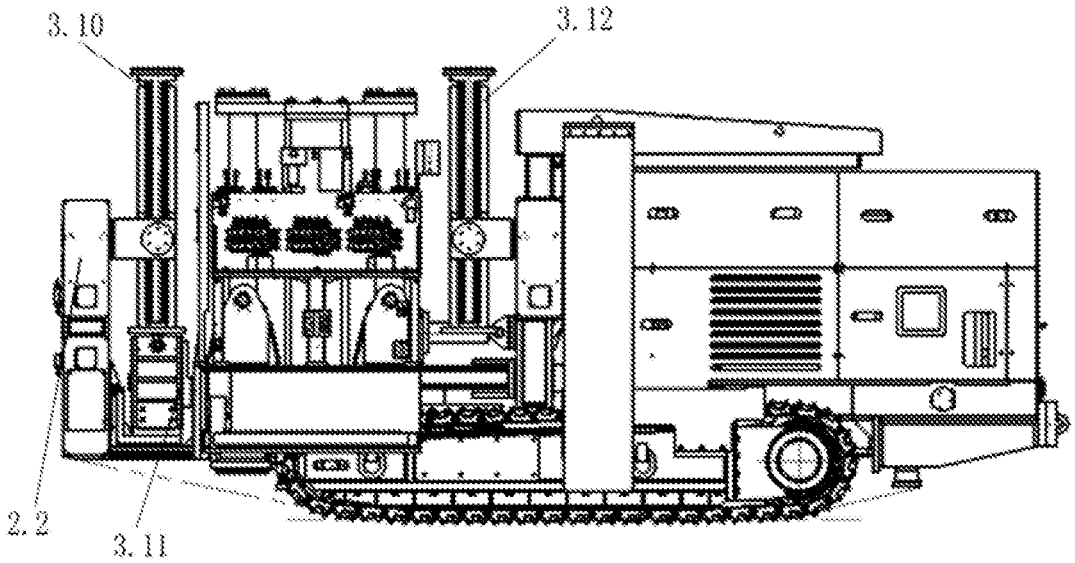
FIG. 23 illustrates a schematic diagram of a top anchor cable support state of four drill machines.

In an embodiment, as shown in FIG. 19 and FIG. 23, the front and rear parts of the anchor bolt and anchor cable support working portion 2 are provided with the front translational slide box 2.2 and the rear translational slide box 2.3 respectively, the four drill machines 2.4 installed on the front translational slide box 2.2 form a side anchor bolt drill machine set, and a support task for four side anchor bolts is completed at a time. Two of the four drill machines 2.4 installed on the front translational slide box 2.2 rotate for 100° and drill toward the top plate, form a top anchor cable drill machine set with the other two drill machines 2.4 installed on the rear translational slide box 2.3, and complete a support task of four anchor cables at a time.

As shown in FIG. 15 and FIG. 23, the distance between the front and rear translational slide boxes of the anchor bolt and anchor cable support working portion 2 is adjusted by an adjustment oil cylinder 2.6.0, after the adjustment oil cylinder 2.6.0 is pushed or pulled, the translational slide box 2.3.0 makes its displacement relative to the front translational slide box 2.2, the adjustment range is 1.9-2.1 m, and it is mainly used for the row spacing requirements of different top anchor cable support.

In an embodiment, as shown in FIG. 15, the crawler traveling portion 1 of the anchor bolt drill carriage is provided with a cooling system 1.4, which is cooled by air; the main purpose is to reduce the oil temperature of the hydraulic power system and control the oil temperature of the hydraulic power system to be within reasonable limits.

To sum up, in the mining six-arm anchor bolt and anchor cable drill carriage of some embodiments of the present disclosure, a final execution mechanism is composed of six anchor bolt and anchor cable drill machines. The front and rear parts of the anchor bolt and anchor cable support working portion are provided with translational slide boxes respectively, the four drill machines installed on the front translational slide box form a side anchor bolt drill machine set, and a support task for four side anchor bolts is completed at a time. Two of the four drill machines installed on the front translational slide box rotate for 100°, form a top anchor cable drill machine set with the other two drill machines installed on the rear translational slide, and complete a support task of four anchor cables at a time. The mining six-arm anchor bolt and anchor cable drill carriage of some embodiments of the present disclosure realizes the spanning of semi-mechanized to fully mechanized operations for the support of side anchor bolts and top anchor cables in the domestic roadway tunneling. In addition, the mining six-arm anchor bolt and anchor cable drill carriage of some embodiments of the present disclosure includes a crawler traveling body portion, an anchor bolt and anchor cable support working portion and a lifting oil cylinder. The lifting oil cylinder is configured to provide a driving force, the crawler traveling body portion is used as a fulcrum to push the anchor bolt and anchor cable support working portion to vertically rise or fall, so as to meet working requirements of the anchor bolt and anchor cable support working portion at different heights, and the application range is wide.

According to another embodiment of the present disclosure, as shown in FIG. 1, equipment used in the construction process of a continuous mining working face known to inventors is composed of a four-arm top anchor bolt drill carriage 3.1, a continuous miner 3.3, a shuttle carriage 3.4, a feeding crusher 3.5, a belt conveyor 3.6, and a forklift 3.7. FIG. 1*a* is top anchor bolt support at a right roadway by a four-arm top anchor bolt drill carriage 3.1 and mining of a continuous miner 3.3 at a left roadway. FIG. 1*b* illustrates a schematic diagram for continuing to complete their respective work after the four-arm top anchor bolt drill carriage 3.1 and continuous miner 3.3 exchange positions. As shown in FIG. 2, an embodiment of the present disclosure relates to a process for supporting an anchor bolt and an anchor cable on a continuous mining working face, which is a support process formed by adding a six-arm side anchor bolt and top anchor cable drill carriage 3.2 on the basis of the equipment used in the construction process known to inventors. The support process of some embodiments of the present disclosure is used in conjunction with equipment such as the miner 3.3 and the shuttle carriage 3.4 for the continuous mining working face continuous, which greatly improves the driving efficiency of the continuous mining working face.

In an embodiment, as shown in FIG. 2, two drill carriages with different functions are arranged in a front-rear direction, the four-arm top anchor bolt drill carriage 3.1 is a front carriage mainly used for top anchor bolt support, the six-arm side anchor bolt and top anchor cable drill carriage 3.2 is a rear carriage mainly used for side anchor bolt and top anchor cable support, and the front and rear carriages work in parallel.

Figure 24:
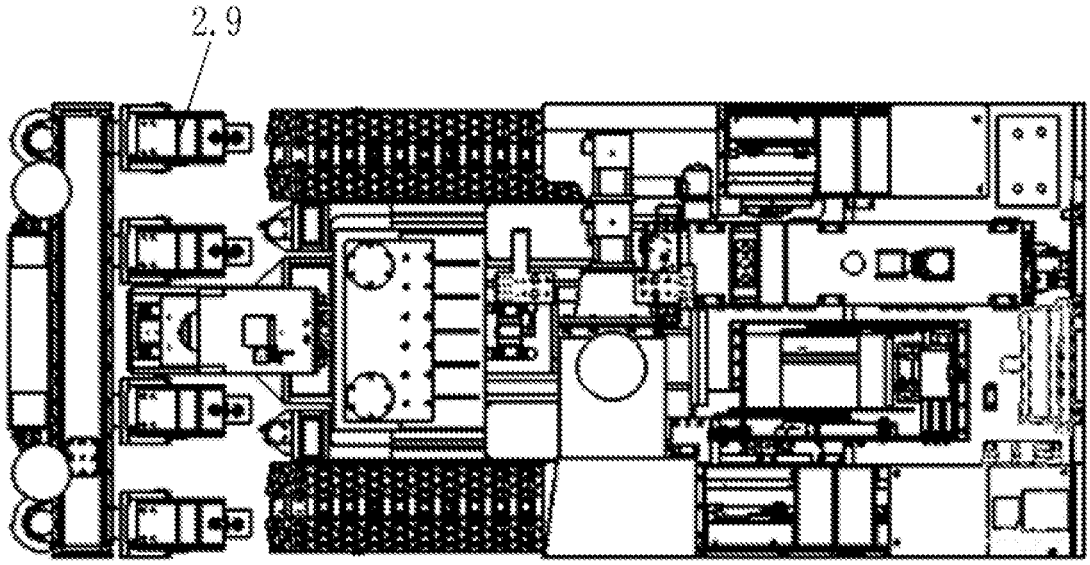
FIG. 24 illustrates a top view of FIG. 3.

In an embodiment, as shown in FIG. 3 and FIG. 24, four anchor bolt drill machines 3.9 of the front carriage (four-arm top anchor bolt drill carriage 3.1) are arranged in a "-" shape, and drill arms toward a top plate. The four anchor bolt drill machines 3.9 may work at the same time to complete supporting of four top anchor bolts, or may perform support for two times. That is, the four anchor bolt drill machines 3.9 work at the same time to complete supporting of four top anchor bolts, and then the top anchor bolt drill machines on both sides are stretched outwards through a telescopic device to complete supporting of two top anchor bolts near a coal side, and a support task of a row of six top anchor bolts is completed.

As shown in FIG. 15 and FIG. 16, four drill machines are disposed in the front of the rear carriage, two on the left and two on the right, the two drill machines on the left or right (upper drill machine 4.10 and lower drill machine 4.11) are disposed horizontally up and down, and toward coal sides on both sides of a roadway respectively. The four drill machines may work at the same time to complete a support task of a row of four side anchor bolts (two side anchor bolts on each side) on a left side and a right side at a time. The four drill machines in the front of the rear carriage are deflected at a certain angle according to the spacing of side anchor bolts to support side anchor bolts during work. The four anchor bolt drill machines may perform supporting for two times, and complete a support task of a row of 6-8 side anchor bolts (3-4 side anchor bolts on each side).

In an embodiment, as shown in FIG. 15, FIG. 16 and FIG. 23, the upper drill machine 4.10 in the drill machines of the rear carriage (six-arm side anchor bolt and top anchor cable drill carriage 3.2) disposed horizontally up and down rotates upward by 90° and toward the top plate in a vertical state, and forms a top anchor cable drill machine set with the other two top anchor cable drill machines 12 installed in the rear and facing the top plate vertically. A support task of two rows of four anchor cables is completed at a time. The top anchor cable drill machine 12 installed in the rear of the rear carriage turns to a horizontal position for side anchor bolt support.

As shown in FIG. 2*a*, the front carriage and the rear carriage cooperate with each other, every time traveling for one step, they complete a support task for a row of top anchor bolts and side anchor bolts respectively, after traveling for eight steps, the front carriage and the rear carriage complete a support task for eight rows (about eight meters) of top anchor bolts and side anchor bolts, and 8 m is an operation cycle.

As shown in FIG. 2*b*, after completing an operation cycle, the front carriage, the rear carriage and the continuous miner 3.3 exchange positions for respective continuous operation.

Figure 25:
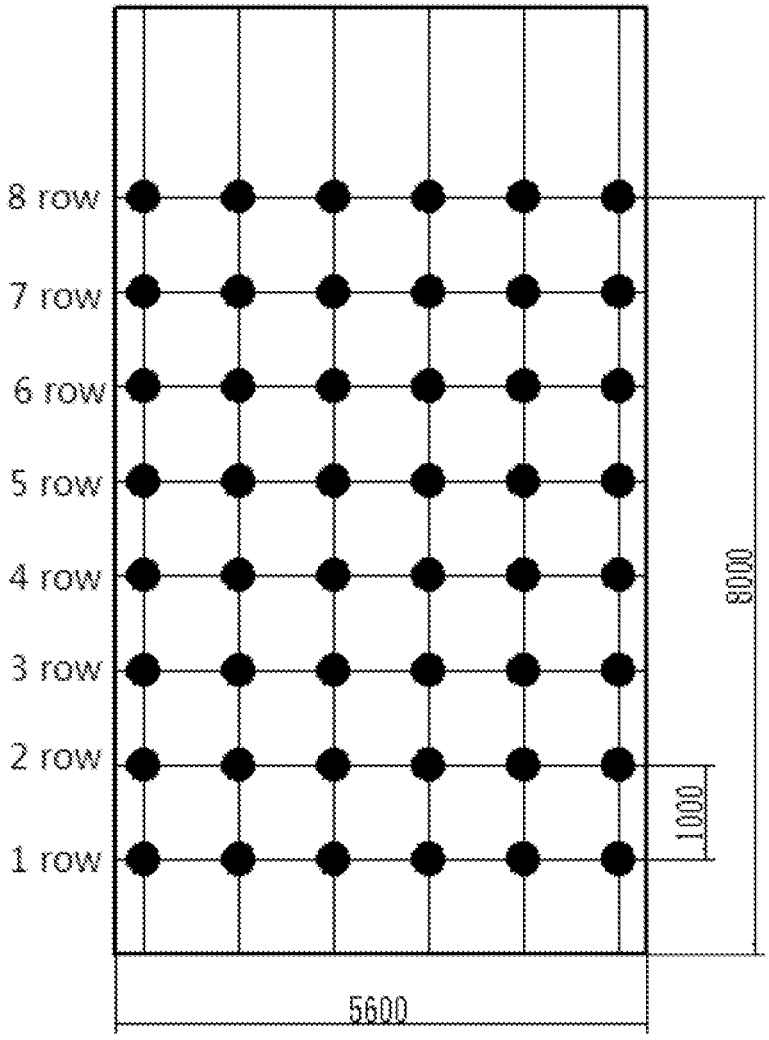
FIG. 25 illustrates a layout view of top anchor bolt support of a four-arm top anchor bolt drill carriage (front carriage) involved in an embodiment of the present disclosure.

As shown in FIG. 25, the front carriage travels in a sequence of step 1, step 2, step 3, . . . , step 8; the rear carriage travels in a sequence of step 1, step 2, step 3, step 3.5, step 4, step 5, step 6, step 7, step 7.5, and step 8; and the rear carriage needs to travel forward for 0.5 step when traveling to the third step and the seventh step to complete reinforced supporting of eight top anchor cables in row 1.5, row 3.5, row 5.5 and row 7.7.

As shown in FIG. 25 and FIG. 7, the front and rear carriage support processes are collectively referred to as a "two-carriage eight-step" method support process, which can realize the one-time completion of three processes of top anchor bolts, side anchor bolts and top anchor cables.

As shown in FIG. 25 and FIG. 7, the "two-carriage eight-row" method support process is not limited to traveling of the front and rear carriages for eight steps as an anchor bolt and anchor cable support cycle. According to the stability of the roadway roof, a "two-carriage N-step" method support process may also be used.

In an embodiment, as shown in FIG. 2, FIG. 3 and FIG. 4, the front carriage has a top anchor cable support function in addition to a top anchor bolt support function. When the number of side anchor bolts required to be supported by the geological conditions is large, the workload of the rear carriage is greater than that of the front carriage. At this moment, the front carriage assists the rear carriage in supporting of a top anchor cable to ensure parallel operation of the front and rear carriages within nearly 100% of the time.

On the basis of the six-arm side anchor bolt and top anchor cable drill carriage newly developed in some embodiments of the present disclosure, a "two-carriage N-step" method support process of parallel operation of the front and rear carriages realizes one-time mechanized support of three processes of for top anchor bolts, side anchor bolts and top anchor cables, particularly realizes timely support of the side anchor bolts and the top anchor cables, and eliminates unsafe factors such as coal side caving and roof caving.

The above are only some embodiments of the present disclosure, and are not intended to limit the present disclosure in any way. Some simple amendments, equivalent changes or modifications made by those skilled in the art using the technical content disclosed above fall within the scope of protection of the present disclosure.

In addition to the above, it is also to be noted that "one embodiment", "another embodiment", "an embodiment" and the like referred to in the specification refers to specific features, structures or characteristics described in connection with the embodiment are included in at least one embodiment of the general description of the present application. The appearance of the same expression in various places in the specification does not necessarily refer to the same embodiment. Further, when a particular feature, structure, or characteristic is described in conjunction with any embodiment, it is claimed that such feature, structure, or characteristic is also included in the scope of the present disclosure.

In the above embodiment, descriptions of each embodiment are emphasized respectively, and parts which are not elaborated in detail in a certain embodiment may refer to relevant descriptions of other embodiments.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A process for supporting an anchor bolt and an anchor cable on a continuous mining working face, comprising a four-arm top anchor bolt drill carriage serves as a front carriage, a six-arm side anchor bolt and top anchor cable drill carriage serves as a rear carriage, and the two carriages are arranged in a front-rear direction to work in parallel; four anchor bolt drill machines of the four-arm top anchor bolt drill carriage form a top anchor bolt drill machine set, and face a top plate, so as to mainly complete top anchor bolt support;

a left drill machine and a right drill machine are disposed in front of the six-arm side anchor bolt and top anchor cable drill carriage; at a distance of L (3.8 m≤L≤4.2 m), another two drill machines are disposed, one drill machine is disposed on the left, the other one drill machine is disposed on the right; the total four drill machines in the front and in the rear form a side anchor bolt support set, and face to two sides of a roadway, so as to mainly complete two-side anchor bolt support; two top anchor cable drill machines are disposed in a middle of the anchor bolt drill machines on front and rear sides to form a top anchor cable drill machine set, and face the top plate, so as to mainly complete top anchor cable reinforced support.

2. The process for supporting the anchor bolt and the anchor cable on the continuous mining working face according to claim 1, wherein the front carriage completes top anchor bolt support in a sequence of row 1, row 2, row 3, row 4, row 5, row 6, row 7, and row 8 every time traveling for 8 steps, and the rear carriage completes side anchor bolt support in a sequence of rows 1 and 5, rows 2 and 6, rows 3 and 7, and rows 4 and 8 every time traveling for 4 steps.

3. The process for supporting the anchor bolt and the anchor cable on the continuous mining working face according to claim 2, wherein a number of traveling steps of the rear carriage in a cycle is half of traveling steps of the front carriage, a nature of a surrounding rock is coal, the side anchor bolt support operation is completed first in a cycle, when waiting for the front carriage to perform the top anchor bolt support operation, the rear carriage performs a multi-row top anchor cable reinforced support operation according to time, after the front carriage completes the top anchor bolt support operation, the rear carriage immediately stops operating, a reinforced anchor cable that is too late to support is supplemented in a maintenance crew, at this moment, the front carriage, the rear carriage and a continuous miner of another roadway exchange positions, and enter another dug roadway for a next anchor bolt and anchor cable support cycling operation.

4. The process for supporting the anchor bolt and the anchor cable on the continuous mining working face according to claim 1, wherein supporting of eight rows serves as a supporting cycle, if an anchor bolt support row distance is 1 m, under a stable geological conditions of a roadway roof, a distance at which a continuous miner cuts coal is 8 m, and an unsupported empty roof distance is less than 10 m, which serves as a cutting cycle matching the supporting cycle.

5. The process for supporting the anchor bolt and the anchor cable on the continuous mining working face according to claim 1, wherein the front carriage comprises a crawler traveling body portion and an anchor bolt support working portion, the anchor bolt support working portion comprises a working platform and four anchor bolt drill machines connected with the working platform; wherein the front carriage further comprises:

a sliding friction pair comprising a guide column and a guide sleeve; and a lifting oil cylinder, installed between the crawler traveling body portion and the working platform, wherein the crawler traveling body portion and the working platform are connected by the sliding friction pair; and under a driving of the lifting oil cylinder, the crawler traveling body portion is used as a fulcrum to push the anchor bolt support working portion to vertically rise or fall.

6. The process for supporting the anchor bolt and the anchor cable on the continuous mining working face according to claim 1, wherein the anchor bolt support working portion further comprises a translational slide box; the translational slide box comprises a fixed slide box fixedly connected with the working platform and sliding slide boxes slidably connected with both sides of the fixed slide box; a middle two anchor bolt drill machines are fixed on the fixed slide box, and the other two anchor bolt drill machines are fixed on the sliding slide boxes on both sides; and the sliding slide boxes slides outwards by 1.35 m relative to the fixed slide box to ensure that the top anchor rods have different spacing requirements.

7. The process for supporting the anchor bolt and the anchor cable on the continuous mining working face according to claim 1, wherein the four anchor bolt drill machines of the front carriage fixed on the translational slide box face to the top plate, and a left-right rotation and front-rear inclination of the drill machines are realized by the left-right rotation and front-rear inclination of an oil cylinder, so that a drill rod is finely adjusted in multiple degrees of freedom to ensure an accuracy of drilling position.

8. The process for supporting the anchor bolt and the anchor cable on the continuous mining working face according to claim 1, wherein the rear carriage comprises a crawler traveling body portion and an anchor bolt and anchor cable support working portion, the anchor bolt and anchor cable support working portion comprises a working platform which is liftable and six anchor bolt drill machines, the six anchor bolt drill machines are all connected with a translational slide box, the translational slide box comprises a fixed slide box connected with the working platform and sliding slide boxes slidably connected with both sides of the fixed slide box, and the six anchor bolt drill machines are all fixed on the sliding slide boxes.

9. The process for supporting the anchor bolt and the anchor cable on the continuous mining working face according to claim 8, wherein front slide boxes are connected with the working platform through a fixed connecting body, the slide boxes lifts up and down relative to the fixed connecting body through a guide friction pair, a lifting power is a lifting oil cylinder, and a maximum lifting height is 1 m; there are two front slide boxes, arranged on both sides of the fixed connecting body, and the sliding slide boxe in each slide boxe slides outwards by 0.5 m relative to the fixed slide box; and a fixing mode and structural parameters of a rear slide box are a same as a fixing mode and structural parameters of the front slide box.

10. The process for supporting the anchor bolt and the anchor cable on the continuous mining working face according to claim 8, wherein a connecting mode of front and rear fixed connecting bodies relative to the working platform is a cylindrical guide slide connection, and front-rear adjustment is performed under an action of a pushing oil cylinder; and by means of the adjustability of the front and rear fixed connecting bodies, an adjustment range of a center distance between the slide box and the fixed front and rear side anchor bolt drill machines is 3.8-4.2 m.

11. The process for supporting the anchor bolt and the anchor cable on the continuous mining working face according to claim 8, wherein for two top anchor cable drill machines disposed in a middle of the rear carriage, a slide box structure comprises a fixed slide box and two sliding slide boxes, the sliding slide boxes slide outwards by 0.5 m respectively relative to the fixed slide box, and the two top anchor cable drill machines fixed on the sliding slide boxes face to the top plate for top anchor cable reinforced support.

12. A mining anchor bolt drill carriage, comprising a crawler traveling body portion and an anchor bolt support working portion, wherein the anchor bolt support working portion comprises a working platform and a plurality of anchor bolt drill machines connected with the working platform; wherein the mining anchor bolt drill carriage further comprises:

a sliding friction pair, comprising a guide column and a guide sleeve; and a lifting oil cylinder, installed between the crawler traveling body portion and the working platform; wherein the crawler traveling body portion and the working platform are connected by the sliding friction pair, and; under a driving of the lifting oil cylinder, the crawler traveling body portion is used as a fulcrum to push the anchor bolt support working portion to vertically rise or fall; the anchor bolt support working portion further comprises a translational slide box; the translational slide box comprises a fixed slide box fixedly connected with the working platform and sliding slide boxes slidably connected with both sides of the fixed slide box;

there are four anchor bolt drill machines, two anchor bolt drill machines on a middle position in the four anchor bolt drill machines are fixed on the fixed slide box, and the other two anchor bolt drill machines in the four anchor bolt drill machines are fixed on the sliding slide boxes on both sides respectively; each of the sliding slide boxes slides outwards by 1.35 m relative to the fixed slide box to ensure that top anchor rods have different spacing requirements; a wear-resistant copper bar is fixed on an outer surface of the each of the sliding slide boxes, a rectangular sliding friction pair is formed between an inner surface of the fixed slide box and the outer surface of the each of the sliding slide boxes, and a clearance of the rectangular sliding friction pair is adjustable.

13. The mining anchor bolt drill carriage according to claim 12, wherein the anchor bolt support working portion further comprises temporary support oil cylinders, and the temporary support oil cylinders are fixed on both sides of a front of the translational slide box through a flat key and a bolt, and each of the temporary support oil cylinders comprise two upper supporting oil cylinders and two lower supporting oil cylinders.

14. A mining six-arm anchor bolt and anchor cable drill carriage, comprising an anchor bolt and anchor cable support working portion, wherein the anchor bolt and anchor cable support working portion comprises a liftable working platform and six drill machines, and further comprises translational slide boxes connected with a front and rear of the working platform, and the front and rear translational slide boxes respectively comprises a fixed slide box connected with the working platform and sliding slide boxes slidably connected with both sides of the fixed slide box;

four drill machines in the six drill machines are installed on the sliding slide boxes of the front translational slide box, are arranged on each side in pairs, drill toward coal walls on both sides, and form a side anchor bolt drill machine set; another two drill machines in the six drill machines are installed on the sliding slide boxes of the rear translational slide box with one drill machine on each side, and drill toward a top plate for top anchor cable support; wear-resistant copper bars are fixed on outer surfaces of the sliding slide boxes, a rectangular sliding friction pair is formed with an inner surface of the fixed slide box, and a clearance of the rectangular sliding friction pair is adjustable; the front translational slide box comprises one fixed slide box and four sliding slide boxes, two sliding slide boxes on each side are arranged up and down, and each of the four sliding slide boxes is provided with one of the drill machines.

15. The mining six-arm anchor bolt and anchor cable drill carriage according to claim 14, wherein two of the four drill machines on the front translational slide box is rotatable by 100°, so that the drill machines drill toward the top plate and form a top anchor cable drill machine set with the other two drill machines that are installed on the rear translational slide box and face to the top plate.

16. A process for supporting an anchor bolt and an anchor cable on a continuous mining working face, comprising a four-arm top anchor bolt drill carriage serves as a front carriage, a six-arm side anchor bolt and top anchor cable drill carriage serves as a rear carriage, and the two carriages are arranged in a front-rear direction to work in parallel, wherein the six-arm side anchor bolt and top anchor cable drill carriage is the mining six-arm anchor bolt and anchor cable drill carriage according to claim 14;

four anchor bolt drill machines of the four-arm top anchor bolt drill carriage face to a top plate;

two left drill machines and two right drill machines are disposed in a front of the six-arm side anchor bolt and top anchor cable drill carriage horizontally up and down, and respectively toward coal sides on both sides of a roadway;

two drill machines are disposed in a rear of the six-arm side anchor bolt and top anchor cable drill carriage, one of the two drill machines on a left, and the other one of the two drill machines on a right, and the two drill machines vertically toward the top plate; an upper drill machine in the left and right drill machines horizontally disposed up and down in the front rotates up by 90° to toward the top plate in a vertical state, and forms a top anchor cable drill machine set with two drill machines installed in the rear and facing the top plate; a two-carriage N-step method is adopted, two carriages have a same step length, and N is a positive integer greater than 3;

the front carriage completes a support task for a row of top anchor bolts every time traveling for one step, and the rear carriage completes a support task for side anchor bolts on left and right sides every time traveling for one step; the rear carriage also needs to travel forward for 0.5 step when traveling to the third step and the 3+4nth step to complete supporting of a top anchor cable, n is 0 or a positive integer, $3+4n<N$, N steps serve as a cycle, and after a cycle of support operation is completed, the front carriage, the rear carriage and a continuous miner of another roadway exchange positions, and enter another dug roadway for a next anchor bolt and anchor cable support cycling operation.

17. The process for supporting the anchor bolt and the anchor cable on the continuous mining working face according to claim 16, wherein a two-carriage eight-step method is adopted, the front carriage travels in a sequence of step 1, step 2, step 3, step 4, step 5, step 6, step 7, and step 8 to complete a support task for 8 rows of top anchor bolts; the rear carriage travels in a sequence of step 1, step 2, step 3, step 3.5, step 4, step 5, step 6, step 7, step 7.5, and step 8; and the rear carriage travels forward for 0.5 step when traveling to a third step and a seventh step to complete reinforced supporting of eight top anchor cables in row 1.5, row 3.5, row 5.5 and row 7.7 in addition to completing a support task for 8 rows of side anchor bolts.

18. The process for supporting the anchor bolt and the anchor cable on the continuous mining working face according to claim 16, wherein every time traveling for one step, the four anchor bolt drill machines of the front carriage work at the same time to complete supporting of four top anchor bolts; or, every time traveling for one step, supporting is performed for two times, the four anchor bolt drill machines first work at the same time to complete supporting of four top anchor bolts, then anchor bolt drill machines on both sides are stretched outwards by a telescopic device to complete support of two top anchor bolts near a coal side, and support of a total of six top anchor bolts in a row is completed.

19. The process for supporting the anchor bolt and the anchor cable on the continuous mining working face according to claim 16, wherein the four drill machines in a front of the rear carriage are deflected at a certain angle according to a spacing of side anchor bolts to support the anchor bolts during work; every time traveling for one step, the four anchor bolt drill machines work at a same time to complete supporting of four side anchor bolts on left and right sides and in a row; or, every time traveling for one step, the four anchor bolt drill machines complete supporting for two times to complete a support task for a row of 6-8 side anchor bolts with 3-4 anchor bolts on each side.

20. The process for supporting the anchor bolt and the anchor cable on the continuous mining working face according to claim 19, wherein a top anchor cable drill machine installed in a rear of the rear carriage also has an up-down rotation function, and performs side anchor bolt support when rotating to a horizontal state.

* * * * *